US011098720B2

(12) United States Patent
Cooper

(10) Patent No.: US 11,098,720 B2
(45) **Date of Patent: *Aug. 24, 2021**

(54) TENSIONED ROTOR SHAFT FOR MOLTEN METAL

(71) Applicant: Molten Metal Equipment Innovations, LLC, Middlefield, OH (US)

(72) Inventor: Paul V. Cooper, Chesterland, OH (US)

(73) Assignee: Molten Metal Equipment Innovations, LLC, Middlefield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/792,643

(22) Filed: Feb. 17, 2020

(65) Prior Publication Data

US 2020/0182248 A1 Jun. 11, 2020

Related U.S. Application Data

(63) Continuation of application No. 16/144,873, filed on Sep. 27, 2018, now Pat. No. 10,641,270, which is a (Continued)

(51) Int. Cl.

| | |
|---|---|
| ***F04D 7/06*** | (2006.01) |
| ***F04D 29/043*** | (2006.01) |
| ***F04D 29/62*** | (2006.01) |
| ***F04D 29/02*** | (2006.01) |
| *F04D 29/60* | (2006.01) |

(Continued)

(52) U.S. Cl.

CPC ..... *F04D 7/065* (2013.01); *F04D 29/043* (2013.01); *F04D 29/628* (2013.01); *B22D 39/00* (2013.01); *F04D 13/06* (2013.01); *F04D 29/026* (2013.01); *F04D 29/605* (2013.01); *F05D 2300/20* (2013.01)

(58) Field of Classification Search

CPC ..... F04D 7/065; F04D 29/628; F04D 29/043; F04D 29/02; F04D 29/026; B22D 39/00

See application file for complete search history.

(56) References Cited

U.S. PATENT DOCUMENTS

| | | |
|---|---|---|
| 35,604 A | 6/1862 | Guild |
| 116,797 A | 7/1871 | Barnhart |

(Continued)

FOREIGN PATENT DOCUMENTS

| | | |
|---|---|---|
| CA | 683469 | 3/1964 |
| CA | 2115929 | 8/1992 |

(Continued)

OTHER PUBLICATIONS

"Response to Final Office Action and Request for Continued Examination for U.S. Appl. No. 09/275,627," Including Declarations of Haynes and Johnson, dated Apr. 16, 2001.

(Continued)

*Primary Examiner* — Peter J Bertheaud

(74) *Attorney, Agent, or Firm* — Snell & Wilmer L.L.P.

(57) ABSTRACT

A vertical member, which is preferably a support post used in a molten metal pump, includes a ceramic tube and tensioning structures to add a compressive load to the tube along its longitudinal axis. This makes the tube less prone to breakage. A device, such as a pump, used in a molten metal bath includes one or more of such vertical members.

23 Claims, 32 Drawing Sheets

Related U.S. Application Data continuation of application No. 15/406,515, filed on Jan. 13, 2017, now Pat. No. 10,267,314.

(60) Provisional application No. 62/278,314, filed on Jan. 13, 2016.

(51) Int. Cl.
*F04D 13/06* (2006.01)
*B22D 39/00* (2006.01)

(56) References Cited

U.S. PATENT DOCUMENTS 209,219 A 10/1878 Bookwalter
251,104 A 12/1881 Finch
307,845 A 11/1884 Curtis
364,804 A 6/1887 Cole
390,319 A 10/1888 Thomson
495,760 A 4/1893 Seitz
506,572 A 10/1893 Wagener
585,188 A 6/1897 Davis
757,932 A 4/1904 Jones
882,477 A 3/1908 Neumann
882,478 A 3/1908 Neumann
890,319 A 6/1908 Wells
898,499 A 9/1908 O'donnell
909,774 A 1/1909 Flora
919,194 A 4/1909 Livingston
1,037,659 A 9/1912 Rembert
1,100,475 A 6/1914 Frankaerts
1,170,512 A 2/1916 Chapman
1,196,758 A 9/1916 Blair
1,304,068 A 5/1919 Krogh
1,331,997 A 2/1920 Neal
1,185,314 A 3/1920 London
1,377,101 A 5/1921 Sparling
1,380,798 A 6/1921 Hansen et al.
1,439,365 A 12/1922 Hazell
1,454,967 A 5/1923 Gill
1,470,607 A 10/1923 Hazell
1,513,875 A 11/1924 Wilke
1,518,501 A 12/1924 Gill
1,522,765 A 1/1925 Wilke
1,526,851 A 2/1925 Hall
1,669,668 A 5/1928 Marshall
1,673,594 A 6/1928 Schmidt
1,697,202 A 1/1929 Nagle
1,717,969 A 6/1929 Goodner
1,718,396 A 6/1929 Wheeler
1,896,201 A 2/1933 Sterner-Rainer
1,988,875 A 1/1935 Saborio
2,013,455 A 9/1935 Baxter
2,038,221 A 4/1936 Kagi
2,075,633 A 3/1937 Anderegg
2,090,162 A 8/1937 Tighe
2,091,677 A 8/1937 Fredericks
2,138,814 A 12/1938 Bressler
2,173,377 A 9/1939 Schultz, Jr. et al.
2,264,740 A 12/1941 Brown
2,280,979 A 4/1942 Rocke
2,290,961 A 7/1942 Hueuer
2,300,688 A 11/1942 Nagle
2,304,849 A 12/1942 Ruthman
2,368,962 A 2/1945 Blom
2,382,424 A 8/1945 Stepanoff
2,423,655 A 7/1947 Mars et al.
2,488,447 A 11/1949 Tangen et al.
2,493,467 A 1/1950 Sunnen
2,515,097 A 7/1950 Schryber
2,515,478 A 7/1950 Tooley et al.
2,528,208 A 10/1950 Bonsack et al.
2,528,210 A 10/1950 Stewart
2,543,633 A 2/1951 Lamphere
2,566,892 A 4/1951 Jacobs
2,625,720 A 1/1953 Ross
2,626,086 A 1/1953 Forrest
2,676,279 A 4/1954 Wilson
2,677,609 A 4/1954 Moore et al.
2,698,583 A 1/1955 House et al.
2,714,354 A 8/1955 Farrand
2,762,095 A 9/1956 Pemetzrieder
2,768,587 A 10/1956 Corneil
2,775,348 A 12/1956 Williams
2,779,574 A 1/1957 Schneider
2,787,873 A 4/1957 Hadley
2,808,782 A 10/1957 Thompson et al.
2,809,107 A 10/1957 Russell
2,821,472 A 1/1958 Peterson et al.
2,824,520 A 2/1958 Bartels
2,832,292 A 4/1958 Edwards
2,839,006 A 6/1958 Mayo
2,853,019 A 9/1958 Thorton
2,865,295 A 12/1958 Nikolaus
2,865,618 A 12/1958 Abell
2,868,132 A 1/1959 Rittershofer
2,901,006 A 8/1959 Andrews
2,901,677 A 8/1959 Chessman et al.
2,906,632 A 9/1959 Nickerson
2,918,876 A 12/1959 Howe
2,948,524 A 8/1960 Sweeney et al.
2,958,293 A 11/1960 Pray, Jr.
2,966,345 A 12/1960 Ciabattari
2,966,381 A 12/1960 Menzel
2,978,885 A 4/1961 Davison
2,984,524 A 5/1961 Franzen
2,987,885 A 6/1961 Hodge
3,010,402 A 11/1961 King
3,015,190 A 1/1962 Arbeit
3,039,864 A 6/1962 Hess
3,044,408 A 7/1962 Mellott
3,048,384 A 8/1962 Sweeney et al.
3,070,393 A 12/1962 Silverberg et al.
3,092,030 A 6/1963 Wunder
3,099,870 A 8/1963 Seeler
3,128,327 A 4/1964 Upton
3,130,678 A 4/1964 Chenault
3,130,679 A 4/1964 Sence
3,171,357 A 3/1965 Egger
3,172,850 A 3/1965 Englesberg et al.
3,203,182 A 8/1965 Pohl
3,227,547 A 1/1966 Szekely
3,244,109 A 4/1966 Barske
3,251,676 A 5/1966 Johnson
3,255,702 A 6/1966 Gehrm
3,258,283 A 6/1966 Winberg et al.
3,272,619 A 9/1966 Sweeney et al.
3,289,473 A 12/1966 Louda
3,291,473 A 12/1966 Sweeney et al.
3,368,805 A 2/1968 Davey et al.
3,374,943 A 3/1968 Cervenka
3,400,923 A 9/1968 Howie et al.
3,417,929 A 12/1968 Secrest et al.
3,432,336 A 3/1969 Langrod
3,459,133 A 8/1969 Scheffler
3,459,346 A 8/1969 Tinnes
3,477,383 A 11/1969 Rawson et al.
3,487,805 A 1/1970 Satterthwaite
3,512,762 A 5/1970 Umbricht
3,512,788 A 5/1970 Kilbane
3,532,445 A 10/1970 Scheffler et al.
3,561,885 A 2/1971 Lake
3,575,525 A 4/1971 Fox et al.
3,581,767 A 6/1971 Jackson
3,612,715 A 10/1971 Yedidiah
3,618,917 A 11/1971 Fredrikson
3,620,716 A 11/1971 Hess
3,650,730 A 3/1972 Derham et al.
3,689,048 A 9/1972 Foulard et al.
3,715,112 A 2/1973 Carbonnel
3,732,032 A 5/1973 Daneel
3,737,304 A 6/1973 Blayden
3,737,305 A 6/1973 Blayden et al.
3,743,263 A 7/1973 Szekely
3,743,500 A 7/1973 Foulard et al.

(56) References Cited

U.S. PATENT DOCUMENTS 3,753,690 A 8/1973 Emley et al.
3,759,628 A 9/1973 Kempf
3,759,635 A 9/1973 Carter et al.
3,767,382 A 10/1973 Bruno et al.
3,776,660 A 12/1973 Anderson et al.
3,785,632 A 1/1974 Kraemer et al.
3,787,143 A 1/1974 Carbonnel et al.
3,799,522 A 3/1974 Brant et al.
3,799,523 A 3/1974 Seki
3,807,708 A 4/1974 Jones
3,814,400 A 6/1974 Seki
3,824,028 A 7/1974 Zenkner et al.
3,824,042 A 7/1974 Barnes et al.
3,836,280 A 9/1974 Koch
3,839,019 A 10/1974 Bruno et al.
3,844,972 A 10/1974 Tully, Jr. et al.
3,871,872 A 3/1975 Downing et al.
3,873,073 A 3/1975 Baum et al.
3,873,305 A 3/1975 Claxton et al.
3,881,039 A 4/1975 Baldieri et al.
3,886,992 A 6/1975 Maas et al.
3,915,594 A 10/1975 Nesseth
3,915,694 A 10/1975 Ando
3,935,003 A 1/1976 Steinke et al.
3,941,588 A 3/1976 Dremann
3,941,589 A 3/1976 Norman et al.
3,942,473 A 3/1976 Chodash
3,954,134 A 5/1976 Maas et al.
3,958,979 A 5/1976 Valdo
3,958,981 A 5/1976 Forberg et al.
3,961,778 A 6/1976 Carbonnel et al.
3,966,456 A 6/1976 Ellenbaum et al.
3,967,286 A 6/1976 Andersson et al.
3,972,709 A 8/1976 Chin et al.
3,973,871 A 8/1976 Hance
3,984,234 A 10/1976 Claxton et al.
3,985,000 A 10/1976 Hartz
3,997,336 A 12/1976 Van Linden et al.
4,003,560 A 1/1977 Carbonnel
4,008,884 A 2/1977 Fitzpatrick et al.
4,018,598 A 4/1977 Markus
4,043,146 A 8/1977 Stegherr
4,052,199 A 10/1977 Mangalick
4,055,390 A 10/1977 Young
4,063,849 A 12/1977 Modianos
4,068,965 A 1/1978 Lichti
4,073,606 A 2/1978 Eller
4,091,970 A 5/1978 Kimiyama et al.
4,119,141 A 10/1978 Thut et al.
4,125,146 A 11/1978 Muller
4,126,360 A 11/1978 Miller et al.
4,128,415 A 12/1978 Van Linden et al.
4,144,562 A 3/1979 Cooper
4,147,474 A 4/1979 Heimdal et al.
4,169,584 A 10/1979 Mangalick
4,191,486 A 3/1980 Pelton
4,192,011 A 3/1980 Cooper et al.
4,213,091 A 7/1980 Cooper
4,213,176 A 7/1980 Cooper
4,213,742 A 7/1980 Henshaw
4,219,882 A 8/1980 Cooper et al.
4,242,039 A 12/1980 Villard et al.
4,244,423 A 1/1981 Thut et al.
4,286,985 A 9/1981 van Linden et al.
4,305,214 A 12/1981 Hurst
4,322,245 A 3/1982 Claxton
4,338,062 A 7/1982 Neal
4,347,041 A 8/1982 Cooper
4,351,514 A 9/1982 Koch
4,355,789 A 10/1982 Dolzhenkov et al.
4,356,940 A 11/1982 Ansorge
4,360,314 A 11/1982 Pennell
4,370,096 A 1/1983 Church
4,372,541 A 2/1983 Bocourt et al.
4,375,937 A 3/1983 Cooper
4,389,159 A 6/1983 Sarvanne
4,392,888 A 7/1983 Eckert et al.
4,410,299 A 10/1983 Shimoyama
4,419,049 A 12/1983 Gerboth et al.
4,456,424 A 6/1984 Araoka
4,456,974 A 6/1984 Cooper
4,470,846 A 9/1984 Dube
4,474,315 A 10/1984 Gilbert et al.
4,489,475 A 12/1984 Struttmann
4,496,393 A 1/1985 Lustenberger
4,504,392 A 3/1985 Groteke
4,509,979 A 4/1985 Bauer
4,537,624 A 8/1985 Tenhover et al.
4,537,625 A 8/1985 Tenhover et al.
4,545,887 A * 10/1985 Arnesen ..... C02F 1/48
204/280
4,556,419 A 12/1985 Otsuka et al.
4,557,766 A 12/1985 Tenhover et al.
4,586,845 A 5/1986 Morris
4,592,700 A 6/1986 Toguchi et al.
4,593,597 A 6/1986 Albrecht et al.
4,594,052 A 6/1986 Niskanen
4,596,510 A 6/1986 Arneth et al.
4,598,899 A 7/1986 Cooper
4,600,222 A 7/1986 Appling
4,607,825 A 8/1986 Briolle et al.
4,609,442 A 9/1986 Tenhover et al.
4,611,790 A 9/1986 Otsuka et al.
4,617,232 A 10/1986 Chandler et al.
4,634,105 A 1/1987 Withers et al.
4,640,666 A 2/1987 Sodergard
4,651,806 A 3/1987 Allen et al.
4,655,610 A 4/1987 Al-Jaroudi
4,673,434 A 6/1987 Withers et al.
4,682,585 A 7/1987 Hilterbrandt
4,684,281 A 8/1987 Patterson
4,685,822 A 8/1987 Pelton
4,696,703 A 9/1987 Henderson et al.
4,701,226 A 10/1987 Henderson et al.
4,702,768 A 10/1987 Areauz et al.
4,714,371 A 12/1987 Cuse
4,717,540 A 1/1988 McRae et al.
4,739,974 A 4/1988 Mordue
4,743,428 A 5/1988 McRae et al.
4,747,583 A 5/1988 Gordon et al.
4,767,230 A 8/1988 Leas, Jr.
4,770,701 A 9/1988 Henderson et al.
4,786,230 A 11/1988 Thut
4,802,656 A 2/1989 Hudault et al.
4,804,168 A 2/1989 Otsuka et al.
4,810,314 A 3/1989 Henderson et al.
4,822,473 A * 4/1989 Arnesen ..... B01J 19/087
204/667
4,834,573 A 5/1989 Asano et al.
4,842,227 A 6/1989 Harrington et al.
4,844,425 A 7/1989 Piras et al.
4,851,296 A 7/1989 Tenhover et al.
4,859,413 A 8/1989 Harris et al.
4,860,819 A 8/1989 Moscoe et al.
4,867,638 A 9/1989 Handtmann et al.
4,884,786 A 12/1989 Gillespie
4,898,367 A 2/1990 Cooper
4,908,060 A 3/1990 Duenkelmann
4,911,726 A 3/1990 Warkentin
4,923,770 A 5/1990 Grasselli et al.
4,930,986 A 6/1990 Cooper
4,931,091 A 6/1990 Waite et al.
4,940,214 A 7/1990 Gillespie
4,940,384 A 7/1990 Amra et al.
4,954,167 A 9/1990 Cooper
4,973,433 A 11/1990 Gilbert et al.
4,986,736 A 1/1991 Kajiwara
4,989,736 A 2/1991 Andersson et al.
5,006,232 A 4/1991 Lidgitt et al.
5,015,518 A 5/1991 Sasaki et al.
5,025,198 A 6/1991 Mordue et al.
5,028,211 A 7/1991 Mordue et al.
5,029,821 A 7/1991 Bar-on et al.
5,049,841 A 9/1991 Cooper et al.

(56) References Cited

U.S. PATENT DOCUMENTS 5,058,654 A 10/1991 Simmons
5,078,572 A 1/1992 Amra et al.
5,080,715 A 1/1992 Provencher et al.
5,083,753 A 1/1992 Soofie
5,088,893 A 2/1992 Gilbert et al.
5,092,821 A 3/1992 Gilbert et al.
5,098,134 A 3/1992 Monckton
5,099,554 A 3/1992 Cooper
5,114,312 A 5/1992 Stanislao
5,126,047 A 6/1992 Martin et al.
5,131,632 A 7/1992 Olson
5,135,202 A 8/1992 Yamashita et al.
5,143,357 A 9/1992 Gilbert et al.
5,145,322 A 9/1992 Senior, Jr. et al.
5,152,631 A 10/1992 Bauer
5,154,652 A 10/1992 Ecklesdafer
5,158,440 A 10/1992 Cooper et al.
5,162,858 A 11/1992 Shoji et al.
5,165,858 A 11/1992 Gilbert et al.
5,172,458 A 12/1992 Cooper
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,303,903 A 4/1994 Butler et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,383,651 A 1/1995 Blasen et al.
5,388,633 A 2/1995 Mercer, II et al.
5,395,405 A 3/1995 Nagel et al.
5,399,074 A 3/1995 Nose et al.
5,407,294 A 4/1995 Giannini
5,411,240 A 5/1995 Rapp et al.
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,494,382 A 2/1996 Kloppers
5,495,746 A 3/1996 Sigworth
5,505,143 A 4/1996 Nagel
5,505,435 A 4/1996 Laszlo
5,509,791 A 4/1996 Turner
5,511,766 A 4/1996 Vassillicos
5,520,422 A 5/1996 Friedrich
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A * 9/1996 Mordue ..... F04D 7/065
222/596
5,571,486 A 11/1996 Robert et al.
5,585,532 A 12/1996 Nagel
5,586,863 A 12/1996 Gilbert et al.
5,591,243 A 1/1997 Colussi et al.
5,597,289 A 1/1997 Thut
5,613,245 A 3/1997 Robert
5,616,167 A 4/1997 Eckert
5,622,481 A 4/1997 Thut
5,629,464 A 5/1997 Bach et al.
5,634,770 A 6/1997 Gilbert et al.
5,640,706 A 6/1997 Nagel et al.
5,640,707 A 6/1997 Nagel et al.
5,640,709 A 6/1997 Nagel et al.
5,655,849 A 8/1997 McEwen et al.
5,660,614 A 8/1997 Waite et al.
5,662,725 A 9/1997 Cooper
5,676,520 A 10/1997 Thut
5,678,244 A 10/1997 Shaw et al.
5,678,807 A 10/1997 Cooper
5,679,132 A 10/1997 Rauenzahn et al.
5,685,701 A 11/1997 Chandler et al.
5,690,888 A 11/1997 Robert
5,695,732 A 12/1997 Sparks et al.
5,716,195 A 2/1998 Thut
5,717,149 A 2/1998 Nagel et al.
5,718,416 A 2/1998 Flisakowski et al.
5,735,668 A 4/1998 Klien
5,735,935 A 4/1998 Areaux
5,741,422 A 4/1998 Eichenmiller et al.
5,744,117 A 4/1998 Wilikinson et al.
5,745,861 A 4/1998 Bell et al.
5,755,847 A 5/1998 Quayle
5,772,324 A 6/1998 Falk
5,776,420 A 7/1998 Nagel
5,785,494 A 7/1998 Vild et al.
5,805,067 A 9/1998 Bradley et al.
5,810,311 A 9/1998 Davison et al.
5,842,832 A 12/1998 Thut
5,846,481 A 12/1998 Tilak
5,858,059 A 1/1999 Abramovich et al.
5,863,314 A 1/1999 Morando
5,864,316 A 1/1999 Bradley et al.
5,866,095 A 2/1999 McGeever et al.
5,875,385 A 2/1999 Stephenson et al.
5,935,528 A 8/1999 Stephenson et al.
5,944,496 A 8/1999 Cooper
5,947,705 A 9/1999 Mordue et al.
5,948,352 A 9/1999 Jagt
5,949,369 A 9/1999 Bradley et al.
5,951,243 A 9/1999 Cooper
5,961,285 A 10/1999 Meneice et al.
5,963,580 A 10/1999 Eckert
5,992,230 A 11/1999 Scarpa et al.
5,993,726 A 11/1999 Huang
5,993,728 A 11/1999 Vild
5,995,041 A 11/1999 Bradley et al.
6,019,576 A 2/2000 Thut
6,024,286 A 2/2000 Bradley et al.
6,027,685 A 2/2000 Cooper
6,036,745 A 3/2000 Gilbert et al.
6,074,455 A 6/2000 Van Linden et al.
6,082,965 A 7/2000 Morando
6,093,000 A 7/2000 Cooper
6,096,109 A 8/2000 Nagel et al.
6,113,154 A 9/2000 Thut
6,123,523 A 9/2000 Cooper
6,152,691 A 11/2000 Thut
6,168,753 B1 1/2001 Morando
6,187,096 B1 2/2001 Thut
6,199,836 B1 3/2001 Rexford et al.
6,217,823 B1 4/2001 Vild et al.
6,231,639 B1 5/2001 Eichenmiller
6,243,366 B1 6/2001 Bradley et al.
6,250,881 B1 6/2001 Mordue et al.
6,254,340 B1 7/2001 Vild et al.
6,270,717 B1 8/2001 Tremblay et al.
6,280,157 B1 8/2001 Cooper
6,293,759 B1 9/2001 Thut
6,303,074 B1 10/2001 Cooper
6,345,964 B1 2/2002 Cooper
6,354,796 B1 3/2002 Morando

(56) References Cited

U.S. PATENT DOCUMENTS 6,358,467 B1 3/2002 Mordue
6,364,930 B1 4/2002 Kos
6,371,723 B1 4/2002 Grant et al.
6,398,525 B1 6/2002 Cooper
6,439,860 B1 8/2002 Greer
6,451,247 B1 * 9/2002 Mordue ..... B22D 39/00 266/239
6,457,940 B1 10/2002 Lehman
6,457,950 B1 10/2002 Cooper et al.
6,464,458 B2 * 10/2002 Vild ..... F04D 7/065 415/200
6,495,948 B1 12/2002 Garrett, III
6,497,559 B1 12/2002 Grant
6,500,228 B1 12/2002 Klingensmith et al.
6,503,292 B2 1/2003 Klingensmith et al.
6,524,066 B2 2/2003 Thut
6,533,535 B2 3/2003 Thut
6,551,060 B2 4/2003 Mordue et al.
6,562,286 B1 5/2003 Lehman
6,648,026 B2 11/2003 Look et al.
6,656,415 B2 12/2003 Kos
6,679,936 B2 1/2004 Quackenbush
6,689,310 B1 2/2004 Cooper
6,695,510 B1 2/2004 Look et al.
6,709,234 B2 3/2004 Gilbert et al.
6,716,147 B1 4/2004 Hinkle et al.
6,723,276 B1 4/2004 Cooper
6,805,834 B2 10/2004 Thut
6,843,640 B2 1/2005 Mordue et al.
6,848,497 B2 2/2005 Sale et al.
6,869,271 B2 3/2005 Gilbert et al.
6,869,564 B2 3/2005 Gilbert et al.
6,881,030 B2 4/2005 Thut
6,887,424 B2 5/2005 Ohno et al.
6,887,425 B2 * 5/2005 Mordue ..... B22D 39/00 266/235
6,902,696 B2 6/2005 Klingensmith et al.
6,955,489 B2 10/2005 Thut
7,037,462 B2 5/2006 Klingensmith et al.
7,056,322 B2 6/2006 Davison et al.
7,074,361 B2 7/2006 Carolla
7,083,758 B2 8/2006 Tremblay
7,131,482 B2 11/2006 Vincent et al.
7,157,043 B2 1/2007 Neff
7,204,954 B2 4/2007 Mizuno
7,273,582 B2 9/2007 Mordue
7,279,128 B2 10/2007 Kennedy et al.
7,326,028 B2 2/2008 Morando
7,402,276 B2 7/2008 Cooper
7,470,392 B2 12/2008 Cooper
7,476,357 B2 1/2009 Thut
7,481,966 B2 1/2009 Mizuno
7,497,988 B2 3/2009 Thut
7,507,365 B2 3/2009 Thut
7,507,367 B2 3/2009 Cooper
7,543,605 B1 6/2009 Morando
7,731,891 B2 6/2010 Cooper
7,771,171 B2 8/2010 Mohr
7,896,617 B1 3/2011 Morando
7,906,068 B2 3/2011 Cooper
8,075,837 B2 12/2011 Cooper
8,110,141 B2 2/2012 Cooper
8,137,023 B2 3/2012 Greer
8,142,145 B2 3/2012 Thut
8,178,037 B2 5/2012 Cooper
8,328,540 B2 12/2012 Wang
8,333,921 B2 12/2012 Thut
8,337,746 B2 12/2012 Cooper
8,361,379 B2 1/2013 Cooper
8,366,993 B2 2/2013 Cooper
8,409,495 B2 4/2013 Cooper
8,440,135 B2 5/2013 Cooper
8,444,911 B2 5/2013 Cooper
8,449,814 B2 5/2013 Cooper
8,475,594 B2 7/2013 Bright et al.
8,475,708 B2 7/2013 Cooper
8,480,950 B2 7/2013 Jetten et al.
8,501,084 B2 8/2013 Cooper
8,524,146 B2 9/2013 Cooper
8,529,828 B2 9/2013 Cooper
8,535,603 B2 9/2013 Cooper
8,580,218 B2 11/2013 Turenne et al.
8,613,884 B2 12/2013 Cooper
8,714,914 B2 5/2014 Cooper
8,753,563 B2 6/2014 Cooper
8,840,359 B2 9/2014 Vick et al.
8,899,932 B2 12/2014 Tetkoskie et al.
8,915,830 B2 12/2014 March et al.
8,920,680 B2 12/2014 Mao
9,011,761 B2 4/2015 Cooper
9,017,597 B2 4/2015 Cooper
9,034,244 B2 5/2015 Cooper
9,057,376 B2 6/2015 Thut
9,074,601 B1 7/2015 Thut
9,080,577 B2 7/2015 Cooper
9,108,224 B2 8/2015 Schererz
9,108,244 B2 8/2015 Cooper
9,156,087 B2 10/2015 Cooper
9,193,532 B2 11/2015 March et al.
9,205,490 B2 12/2015 Cooper
9,234,520 B2 1/2016 Morando
9,273,376 B2 3/2016 Lutes et al.
9,328,615 B2 5/2016 Cooper
9,377,028 B2 6/2016 Cooper
9,382,599 B2 7/2016 Cooper
9,383,140 B2 7/2016 Cooper
9,409,232 B2 8/2016 Cooper
9,410,744 B2 8/2016 Cooper
9,422,942 B2 8/2016 Cooper
9,435,343 B2 9/2016 Cooper
9,464,636 B2 10/2016 Cooper
9,470,239 B2 10/2016 Cooper
9,476,644 B2 10/2016 Howitt et al.
9,481,035 B2 11/2016 Cooper
9,481,918 B2 11/2016 Vild et al.
9,482,469 B2 11/2016 Cooper
9,494,366 B1 11/2016 Thut
9,506,129 B2 11/2016 Cooper
9,506,346 B2 11/2016 Bright et al.
9,566,645 B2 2/2017 Cooper
9,581,388 B2 2/2017 Cooper
9,587,883 B2 3/2017 Cooper
9,657,578 B2 5/2017 Cooper
9,855,600 B2 1/2018 Cooper
9,862,026 B2 1/2018 Cooper
9,903,383 B2 2/2018 Cooper
9,909,808 B2 3/2018 Cooper
9,925,587 B2 3/2018 Cooper
9,951,777 B2 4/2018 Morando et al.
9,970,442 B2 * 5/2018 Tipton ..... F04D 7/065
9,982,945 B2 5/2018 Cooper
10,052,688 B2 8/2018 Cooper
10,072,897 B2 9/2018 Cooper
10,126,058 B2 11/2018 Cooper
10,126,059 B2 11/2018 Cooper
10,138,892 B2 11/2018 Cooper
10,195,664 B2 2/2019 Cooper et al.
10,267,314 B2 * 4/2019 Cooper ..... F04D 29/043
10,274,256 B2 * 4/2019 Cooper ..... C22B 21/0084
10,302,361 B2 5/2019 Cooper
10,307,821 B2 6/2019 Cooper
10,309,725 B2 6/2019 Cooper
10,322,451 B2 6/2019 Cooper
10,345,045 B2 7/2019 Cooper
10,352,620 B2 7/2019 Cooper
10,428,821 B2 10/2019 Cooper
10,465,688 B2 11/2019 Cooper
10,562,097 B2 2/2020 Cooper
10,641,270 B2 * 5/2020 Cooper ..... F04D 7/065
2001/0000465 A1 4/2001 Thut
2001/0012758 A1 8/2001 Bradley et al.
2002/0089099 A1 7/2002 Denning
2002/0146313 A1 10/2002 Thut
2002/0185790 A1 12/2002 Klingensmith

(56) References Cited

U.S. PATENT DOCUMENTS

| | | | |
|---|---|---|---|
| 2002/0185794 | A1 | 12/2002 | Vincent |
| 2002/0187947 | A1 | 12/2002 | Jarai et al. |
| 2003/0047850 | A1 | 3/2003 | Areaux |
| 2003/0075844 | A1 | 4/2003 | Mordue et al. |
| 2003/0082052 | A1 | 5/2003 | Gilbert et al. |
| 2003/0151176 | A1 | 8/2003 | Ohno |
| 2003/0201583 | A1 | 10/2003 | Klingensmith et al. |
| 2004/0050525 | A1 | 3/2004 | Kennedy et al. |
| 2004/0076533 | A1 | 4/2004 | Cooper |
| 2004/0115079 | A1 | 6/2004 | Cooper |
| 2004/0199435 | A1 | 10/2004 | Abrams et al. |
| 2004/0262825 | A1 | 12/2004 | Cooper |
| 2005/0013713 | A1 | 1/2005 | Cooper |
| 2005/0013714 | A1 | 1/2005 | Cooper |
| 2005/0013715 | A1 | 1/2005 | Cooper |
| 2005/0053499 | A1 | 3/2005 | Cooper |
| 2005/0077730 | A1 | 4/2005 | Thut |
| 2005/0081607 | A1 | 4/2005 | Patel et al. |
| 2005/0116398 | A1 | 6/2005 | Tremblay |
| 2006/0180963 | A1 | 8/2006 | Thut |
| 2007/0253807 | A1 | 11/2007 | Cooper |
| 2008/0202644 | A1 | 8/2008 | Grassi |
| 2008/0211147 | A1 | 9/2008 | Cooper |
| 2008/0213111 | A1 | 9/2008 | Cooper |
| 2008/0230966 | A1 | 9/2008 | Cooper |
| 2008/0253905 | A1 | 10/2008 | Morando et al. |
| 2008/0304970 | A1 | 12/2008 | Cooper |
| 2008/0314548 | A1 | 12/2008 | Cooper |
| 2009/0054167 | A1 | 2/2009 | Cooper |
| 2009/0269191 | A1 | 10/2009 | Cooper |
| 2010/0104415 | A1 | 4/2010 | Morando |
| 2010/0200354 | A1 | 8/2010 | Yagi et al. |
| 2011/0133374 | A1 | 6/2011 | Cooper |
| 2011/0140319 | A1 | 6/2011 | Cooper |
| 2011/0140619 | A1 | 6/2011 | Cooper |
| 2011/0142603 | A1 | 6/2011 | Cooper |
| 2011/0142606 | A1 | 6/2011 | Cooper |
| 2011/0148012 | A1 | 6/2011 | Cooper |
| 2011/0163486 | A1 | 7/2011 | Cooper |
| 2011/0210232 | A1 | 9/2011 | Cooper |
| 2011/0220771 | A1 | 9/2011 | Cooper |
| 2011/0303706 | A1 | 12/2011 | Cooper |
| 2012/0003099 | A1 | 1/2012 | Tetkoskie |
| 2012/0163959 | A1 | 6/2012 | Morando |
| 2013/0105102 | A1 | 5/2013 | Cooper |
| 2013/0142625 | A1 | 6/2013 | Cooper |
| 2013/0214014 | A1 | 8/2013 | Cooper |
| 2013/0224038 | A1 | 8/2013 | Tetkoskie et al. |
| 2013/0292426 | A1 | 11/2013 | Cooper |
| 2013/0292427 | A1 | 11/2013 | Cooper |
| 2013/0299524 | A1 | 11/2013 | Cooper |
| 2013/0299525 | A1 | 11/2013 | Cooper |
| 2013/0306687 | A1 | 11/2013 | Cooper |
| 2013/0334744 | A1 | 12/2013 | Tremblay |
| 2013/0343904 | A1 | 12/2013 | Cooper |
| 2014/0008849 | A1 | 1/2014 | Cooper |
| 2014/0041252 | A1 | 2/2014 | Vild et al. |
| 2014/0044520 | A1 | 2/2014 | Tipton |
| 2014/0083253 | A1 | 3/2014 | Lutes et al. |
| 2014/0210144 | A1 | 7/2014 | Torres et al. |
| 2014/0232048 | A1 | 8/2014 | Howitt et al. |
| 2014/0252701 | A1 | 9/2014 | Cooper |
| 2014/0261800 | A1 | 9/2014 | Cooper |
| 2014/0263482 | A1 | 9/2014 | Cooper |
| 2014/0265068 | A1 | 9/2014 | Cooper |
| 2014/0271219 | A1 | 9/2014 | Cooper |
| 2014/0363309 | A1 | 12/2014 | Henderson et al. |
| 2015/0069679 | A1 | 3/2015 | Henderson et al. |
| 2015/0192364 | A1 | 7/2015 | Cooper |
| 2015/0217369 | A1 | 8/2015 | Cooper |
| 2015/0219111 | A1 | 8/2015 | Cooper |
| 2015/0219112 | A1 | 8/2015 | Cooper |
| 2015/0219113 | A1 | 8/2015 | Cooper |
| 2015/0219114 | A1 | 8/2015 | Cooper |
| 2015/0224574 | A1 | 8/2015 | Cooper |
| 2015/0252807 | A1 | 9/2015 | Cooper |
| 2015/0285558 | A1 | 10/2015 | Cooper |
| 2015/0323256 | A1 | 11/2015 | Cooper |
| 2015/0328682 | A1 | 11/2015 | Cooper |
| 2015/0328683 | A1 | 11/2015 | Cooper |
| 2016/0031007 | A1 | 2/2016 | Cooper |
| 2016/0040265 | A1 | 2/2016 | Cooper |
| 2016/0047602 | A1 | 2/2016 | Cooper |
| 2016/0053762 | A1 | 2/2016 | Cooper |
| 2016/0053814 | A1 | 2/2016 | Cooper |
| 2016/0082507 | A1 | 3/2016 | Cooper |
| 2016/0089718 | A1 | 3/2016 | Cooper |
| 2016/0091251 | A1 | 3/2016 | Cooper |
| 2016/0116216 | A1 | 4/2016 | Schlicht et al. |
| 2016/0221855 | A1 | 8/2016 | Retorick et al. |
| 2016/0250686 | A1 | 9/2016 | Cooper |
| 2016/0265535 | A1 | 9/2016 | Cooper |
| 2016/0305711 | A1 | 10/2016 | Cooper |
| 2016/0320129 | A1 | 11/2016 | Cooper |
| 2016/0320130 | A1 | 11/2016 | Cooper |
| 2016/0320131 | A1 | 11/2016 | Cooper |
| 2016/0346836 | A1 | 12/2016 | Henderson et al. |
| 2016/0348973 | A1 | 12/2016 | Cooper |
| 2016/0348974 | A1 | 12/2016 | Cooper |
| 2016/0348975 | A1 | 12/2016 | Cooper |
| 2017/0037852 | A1 | 2/2017 | Bright et al. |
| 2017/0038146 | A1 | 2/2017 | Cooper |
| 2017/0045298 | A1 | 2/2017 | Cooper |
| 2017/0056973 | A1 | 3/2017 | Tremblay et al. |
| 2017/0082368 | A1 | 3/2017 | Cooper |
| 2017/0106435 | A1 | 4/2017 | Vincent |
| 2017/0167793 | A1 | 6/2017 | Cooper et al. |
| 2017/0198721 | A1 | 7/2017 | Cooper |
| 2017/0219289 | A1 | 8/2017 | Williams et al. |
| 2017/0241713 | A1 | 8/2017 | Henderson et al. |
| 2017/0246681 | A1 | 8/2017 | Tipton et al. |
| 2017/0276430 | A1 | 9/2017 | Cooper |
| 2018/0058465 | A1 | 3/2018 | Cooper |
| 2018/0111189 | A1 | 4/2018 | Cooper |
| 2018/0178281 | A1 | 6/2018 | Cooper |
| 2018/0195513 | A1 | 7/2018 | Cooper |
| 2018/0311726 | A1 | 11/2018 | Cooper |
| 2019/0032675 | A1 | 1/2019 | Cooper |
| 2019/0270134 | A1 | 9/2019 | Cooper |
| 2019/0293089 | A1 | 9/2019 | Cooper |
| 2019/0360491 | A1 | 11/2019 | Cooper |
| 2019/0360492 | A1 | 11/2019 | Cooper |
| 2019/0368494 | A1 | 12/2019 | Cooper |
| 2020/0130050 | A1 | 4/2020 | Cooper |
| 2020/0130051 | A1 | 4/2020 | Cooper |
| 2020/0130052 | A1 | 4/2020 | Cooper |
| 2020/0130053 | A1 | 4/2020 | Cooper |
| 2020/0130054 | A1 | 4/2020 | Cooper |
| 2020/0182247 | A1 | 6/2020 | Cooper |

FOREIGN PATENT DOCUMENTS

| | | |
|---|---|---|
| CA | 2244251 | 12/1996 |
| CA | 2305865 | 2/2000 |
| CA | 2176475 | 7/2005 |
| CA | 2924572 | 4/2015 |
| CH | 392268 | 9/1965 |
| DE | 1800446 | 12/1969 |
| EP | 168250 | 1/1986 |
| EP | 665378 | 2/1995 |
| EP | 1019635 | 6/2006 |
| GB | 543607 | 3/1942 |
| GB | 942648 | 11/1963 |
| GB | 1185314 | 3/1970 |
| GB | 2217784 | 3/1989 |
| JP | 58048796 | 3/1983 |
| JP | 63104773 | 5/1988 |
| JP | 5112837 | 5/1993 |
| JP | 11-270799 | 10/1999 |
| MX | 227385 | 4/2005 |
| NO | 90756 | 1/1959 |
| SU | 416401 | 2/1974 |
| SU | 773312 | 10/1980 |
| WO | 199808990 | 3/1998 |

(56) References Cited

FOREIGN PATENT DOCUMENTS

| | | |
|---|---|---|
| WO | 199825031 | 6/1998 |
| WO | 200009889 | 2/2000 |
| WO | 2002012147 | 2/2002 |
| WO | 2004029307 | 4/2004 |
| WO | 2010147932 | 12/2010 |
| WO | 2014055082 | 4/2014 |
| WO | 2014150503 | 9/2014 |
| WO | 2014185971 | 11/2014 |

OTHER PUBLICATIONS

Document No. 504217: Excerpts from "Pyrotek Inc.'s Motion for Summary Judgment of Invalidity and Unenforceability of U.S. Pat. No. 7,402,276," Oct. 2, 2009.
Document No. 505026: Excerpts from "MMEI's Response to Pyrotek's Motion for Summary Judgment of Invalidity or Enforceability of U.S. Pat. No. 7,402,276," Oct. 9, 2009.
Document No. 507689: Excerpts from "MMEI's Pre-Hearing Brief and Supplemental Motion for Summary Judgment of Infringment of Claims 3-4, 15, 17-20, 26 and 28-29 of the '074 Patent and Motion for Reconsideration of the Validity of Claims 7-9 of the '276 Patent," Nov. 4, 2009.
Document No. 517158: Excerpts from "Reasoned Award," Feb. 19, 2010.
Document No. 525055: Excerpts from "Molten Metal Equipment Innovations, Inc.'s Reply Brief in Support of Application to Confirm Arbitration Award and Opposition to Motion to Vacate," May 12, 2010.
USPTO; Office Action dated Feb. 23, 1996 in U.S. Appl. No. 08/439,739.
USPTO; Office Action dated Aug. 15, 1996 in U.S. Appl. No. 08/439,739.
USPTO; Advisory Action dated Nov. 18, 1996 in U.S. Appl. No. 08/439,739.
USPTO; Advisory Action dated Dec. 9, 1996 in U.S. Appl. No. 08/439,739.
USPTO; Notice of Allowance dated Jan. 17, 1997 in U.S. Appl. No. 08/439,739.
USPTO; Office Action dated Jul. 22, 1996 in U.S. Appl. No. 08/489,962.
USPTO; Office Action dated Jan. 6, 1997 in U.S. Appl. No. 08/489,962.
USPTO; Interview Summary dated Mar. 4, 1997 in U.S. Appl. No. 08/489,962.
USPTO; Notice of Allowance dated Mar. 27, 1997 in U.S. Appl. No. 08/489,962.
USPTO; Office Action dated Sep. 23, 1998 in U.S. Appl. No. 08/759,780.
USPTO; Interview Summary dated Dec. 30, 1998 in U.S. Appl. No. 08/789,780.
USPTO; Notice of Allowance dated Mar. 17, 1999 in U.S. Appl. No. 08/789,780.
USPTO; Office Action dated Jul. 23, 1998 in U.S. Appl. No. 08/889,882.
USPTO; Office Action dated Jan. 21, 1999 in U.S. Appl. No. 08/889,882.
USPTO; Notice of Allowance dated Mar. 17, 1999 in U.S. Appl. No. 08/889,882.
USPTO; Office Action dated Feb. 26, 1999 in U.S. Appl. No. 08/951,007.
USPTO; Interview Summary dated Mar. 15, 1999 in U.S. Appl. No. 08/951,007.
USPTO; Office Action dated May 17, 1999 in U.S. Appl. No. 08/951,007.
USPTO; Notice of Allowance dated Aug. 27, 1999 in U.S. Appl. No. 08/951,007.
USPTO; Office Action dated Dec. 23, 1999 in U.S. Appl. No. 09/132,934.
USPTO; Notice of Allowance dated Mar. 9, 2000 in U.S. Appl. No. 09/132,934.
USPTO; Office Action dated Jan. 7, 2000 in U.S. Appl. No. 09/152,168.
USPTO; Notice of Allowance dated Aug. 7, 2000 in U.S. Appl. No. 09/152,168.
USPTO; Office Action dated Sep. 29, 1999 in U.S. Appl. No. 09/275,627.
USPTO; Office Action dated May 22, 2000 in U.S. Appl. No. 09/275,627.
USPTO; Office Action dated Nov. 14, 2000 in U.S. Appl. No. 09/275,627.
USPTO; Office Action dated May 21, 2001 in U.S. Appl. No. 09/275,627.
USPTO; Notice of Allowance dated Aug. 31, 2001 in U.S. Appl. No. 09/275,627.
USPTO; Office Action dated Jun. 15, 2000 in U.S. Appl. No. 09/312,361.
USPTO; Notice of Allowance dated Jan. 29, 2001 in U.S. Appl. No. 09/312,361.
USPTO; Office Action dated Jun. 22, 2001 in U.S. Appl. No. 09/569,461.
USPTO; Office Action dated Oct. 12, 2001 in U.S. Appl. No. 09/569,461.
USPTO; Office Action dated May 3, 2002 in U.S. Appl. No. 09/569,461.
USPTO; Advisory Action dated May 14, 2002 in U.S. Appl. No. 09/569,461.
USPTO; Office Action dated Dec. 4, 2002 in U.S. Appl. No. 09/569,461.
USPTO; Interview Summary dated Jan. 14, 2003 in U.S. Appl. No. 09/569,461.
USPTO; Notice of Allowance dated Jun. 24, 2003 in U.S. Appl. No. 09/569,461.
USPTO; Office Action dated Nov. 21, 2000 in U.S. Appl. No. 09/590,108.
USPTO; Office Action dated May 22, 2001 in U.S. Appl. No. 09/590,108.
USPTO; Notice of Allowance dated Sep. 10, 2001 in U.S. Appl. No. 09/590,108.
USPTO; Office Action dated Jan. 30, 2002 in U.S. Appl. No. 09/649,190.
USPTO; Office Action dated Oct. 4, 2002 in U.S. Appl. No. 09/649,190.
USPTO; Office Action dated Apr. 18, 2003 in U.S. Appl. No. 09/649,190.
USPTO; Notice of Allowance dated Nov. 21, 2003 in U.S. Appl. No. 09/649,190.
USPTO; Office Action dated Jun. 7, 2006 in U.S. Appl. No. 10/619,405.
USPTO; Final Office Action dated Feb. 20, 2007 in U.S. Appl. No. 10/619,405.
USPTO; Office Action dated Oct. 9, 2007 in U.S. Appl. No. 10/619,405.
USPTO; Final Office Action dated May 29, 2008 in U.S. Appl. No. 10/619,405.
USPTO; Interview Summary Aug. 22, 2008 in U.S. Appl. No. 10/619,405.
USPTO; Ex Parte Quayle dated Sep. 12, 2008 in U.S. Appl. No. 10/619,405.
USPTO; Interview Summary dated Oct. 16, 2008 in U.S. Appl. No. 10/619,405.
USPTO; Notice of Allowance dated Nov. 14, 2008 in U.S. Appl. No. 10/619,405.
USPTO; Office Action dated Mar. 20, 2006 in U.S. Appl. No. 10/620,318.
USPTO; Office Action dated Nov. 16, 2006 in U.S. Appl. No. 10/620,318.
USPTO; Final Office Action dated Jul. 25, 2007 in U.S. Appl. No. 10/620,318.
USPTO; Office Action dated Feb. 12, 2008 in U.S. Appl. No. 10/620,318.

(56) References Cited

OTHER PUBLICATIONS

USPTO; Final Office Action dated Oct. 16, 2008 in U.S. Appl. No. 10/620,318.
USPTO; Office Action dated Feb. 25, 2009 in U.S. Appl. No. 10/620,318.
USPTO; Final Office Action dated Oct. 8, 2009 in U.S. Appl. No. 10/620,318.
USPTO; Notice of Allowance Jan. 26, 2010 in U.S. Appl. No. 10/620,318.
USPTO; Office Action dated Nov. 15, 2007 in U.S. Appl. No. 10/773,101.
USPTO; Office Action dated Jun. 27, 2006 in U.S. Appl. No. 10/773,102.
USPTO; Final Office Action dated Mar. 6, 2007 in U.S. Appl. No. 10/773,102.
USPTO; Office Action dated Oct. 11, 2007 in U.S. Appl. No. 10/773,102.
USPTO; Interview Summary dated Mar. 18, 2008 in U.S. Appl. No. 10/773,102.
USPTO; Notice of Allowance dated Apr. 18, 2008 in U.S. Appl. No. 10/773,102.
USPTO; Office Action dated Jul. 24, 2006 in U.S. Appl. No. 10/773,105.
USPTO; Final Office Action dated Jul. 21, 2007 in U.S. Appl. No. 10/773,105.
USPTO; Office Action dated Oct. 9, 2007 in U.S. Appl. No. 10/773,105.
USPTO; Interview Summary dated Jan. 25, 2008 in U.S. Appl. No. 10/773,105.
USPTO; Office Action dated May 19, 2008 in U.S. Appl. No. 10/773,105.
USPTO; Interview Summary dated Jul. 21, 2008 in U.S. Appl. No. 10/773,105.
USPTO; Notice of Allowance dated Sep. 29, 2008 in U.S. Appl. No. 10/773,105.
USPTO; Office Action dated Jan. 31, 2008 in U.S. Appl. No. 10/773,118.
USPTO; Final Office Action dated Aug. 18, 2008 in U.S. Appl. No. 10/773,118.
USPTO; Interview Summary dated Oct. 16, 2008 in U.S. Appl. No. 10/773,118.
USPTO; Office Action dated Dec. 15, 2008 in U.S. Appl. No. 10/773,118.
USPTO; Final Office Action dated May 1, 2009 in U.S. Appl. No. 10/773,118.
USPTO; Office Action dated Jul. 27, 2009 in U.S. Appl. No. 10/773,118.
USPTO; Final Office Action dated Feb. 2, 2010 in U.S. Appl. No. 10/773,118.
USPTO; Interview Summary dated Jun. 4, 2010 in U.S. Appl. No. 10/773,118.
USPTO; Ex Parte Quayle Action dated Aug. 25, 2010 in U.S. Appl. No. 10/773,118.
USPTO; Notice of Allowance dated Nov. 5, 2010 in U.S. Appl. No. 10/773,118.
USPTO; Office Action dated Mar. 16, 2005 in U.S. Appl. No. 10/827,941.
USPTO; Final Office Action dated Nov. 7, 2005 in U.S. Appl. No. 10/827,941.
USPTO; Office Action dated Jul. 12, 2006 in U.S. Appl. No. 10/827,941.
USPTO; Final Office Action dated Mar. 8, 2007 in U.S. Appl. No. 10/827,941.
USPTO; Office Action dated Oct. 29, 2007 in U.S. Appl. No. 10/827,941.
USPTO; Office Action dated Sep. 26, 2008 in U.S. Appl. No. 11/413,982.
USPTO; Office Action dated Dec. 11, 2009 in U.S. Appl. No. 11/766,617.
USPTO; Office Action dated Mar. 8, 2010 in U.S. Appl. No. 11/766,617.
USPTO; Final Office Action dated Sep. 20, 2010 in U.S. Appl. No. 11/766,617.
USPTO; Office Action dated Mar. 1, 2011 in U.S. Appl. No. 11/766,617.
USPTO; Final Office Action dated Sep. 22, 2011 in U.S. Appl. No. 11/766,617.
USPTO; Office Action dated Jan. 27, 2012 in U.S. Appl. No. 11/766,617.
USPTO; Notice of Allowance dated May 15, 2012 in U.S. Appl. No. 11/766,617.
USPTO; Supplemental Notice of Allowance dated Jul. 31, 2012 in U.S. Appl. No. 11/766,617.
USPTO; Notice of Allowance dated Aug. 24, 2012 in U.S. Appl. No. 11/766,617.
USPTO; Final Office Action dated Oct. 14, 2008 in U.S. Appl. No. 12/111,835.
USPTO; Office Action dated May 15, 2009 in U.S. Appl. No. 12/111,835.
USPTO; Office Action dated Mar. 31, 2009 in U.S. Appl. No. 12/120,190.
USPTO; Final Office Action dated Dec. 4, 2009 in U.S. Appl. No. 12/120,190.
USPTO; Office Action dated Jun. 28, 2010 in U.S. Appl. No. 12/120,190.
USPTO; Final Office Action dated Jan. 6, 2011 in U.S. Appl. No. 12/120,190.
USPTO; Office Action dated Jun. 27, 2011 in U.S. Appl. No. 12/120,190.
USPTO; Final Office Action dated Nov. 28, 2011 in U.S. Appl. No. 12/120,190.
USPTO; Notice of Allowance dated Feb. 6, 2012 in U.S. Appl. No. 12/120,190.
USPTO; Office Action dated Nov. 3, 2008 in U.S. Appl. No. 12/120,200.
USPTO; Final Office Action dated May 28, 2009 in U.S. Appl. No. 12/120,200.
USPTO; Office Action dated Dec. 18, 2009 in U.S. Appl. No. 12/120,200.
USPTO; Final Office Action dated Jul. 9, 2010 in U.S. Appl. No. 12/120,200.
USPTO; Office Action dated Jan. 21, 2011 in U.S. Appl. No. 12/120,200.
USPTO; Final Office Action dated Jul. 26, 2011 in U.S. Appl. No. 12/120,200.
USPTO; Final Office Action dated Feb. 3, 2012 in U.S. Appl. No. 12/120,200.
USPTO; Notice of Allowance dated Jan. 17, 2013 in U.S. Appl. No. 12/120,200.
USPTO; Office Action dated Jun. 16, 2009 in U.S. Appl. No. 12/146,770.
USPTO; Final Office Action dated Feb. 24, 2010 in U.S. Appl. No. 12/146,770.
USPTO; Office Action dated Jun. 9, 2010 in U.S. Appl. No. 12/146,770.
USPTO; Office Action dated Nov. 18, 2010 in U.S. Appl. No. 12/146,770.
USPTO; Final Office Action dated Apr. 4, 2011 in U.S. Appl. No. 12/146,770.
USPTO; Notice of Allowance dated Aug. 22, 2011 in U.S. Appl. No. 12/146,770.
USPTO; Notice of Allowance dated Nov. 1, 2011 in U.S. Appl. No. 12/146,770.
USPTO; Office Action dated Apr. 27, 2009 in U.S. Appl. No. 12/146,788.
USPTO; Final Office Action dated Oct. 15, 2009 in U.S. Appl. No. 12/146,788.
USPTO; Office Action dated Feb. 16, 2010 in U.S. Appl. No. 12/146,788.
USPTO; Final Office Action dated Jul. 13, 2010 in U.S. Appl. No. 12/146,788.

(56) References Cited

OTHER PUBLICATIONS

USPTO; Office Action dated Apr. 19, 2011 in U.S. Appl. No. 12/146,788.
USPTO; Notice of Allowance dated Aug. 19, 2011 in U.S. Appl. No. 12/146,788.
USPTO; Office Action dated Apr. 13, 2009 in U.S. Appl. No. 12/264,416.
USPTO; Final Office Action dated Oct. 8, 2009 in U.S. Appl. No. 12/264,416.
USPTO; Office Action dated Feb. 1, 2010 in U.S. Appl. No. 12/264,416.
USPTO; Final Office Action dated Jun. 30, 2010 in U.S. Appl. No. 12/264,416.
USPTO; Office Action dated Mar. 17, 2011 in U.S. Appl. No. 12/264,416.
USPTO; Final Office Action dated Jul. 7, 2011 in U.S. Appl. No. 12/264,416.
USPTO; Office Action dated Nov. 4, 2011 in U.S. Appl. No. 12/264,416.
USPTO; Final Office Action dated Jun. 8, 2012 in U.S. Appl. No. 12/264,416.
USPTO; Office Action dated Nov. 28, 2012 in U.S. Appl. No. 12/264,416.
USPTO; Ex Parte Quayle dated Apr. 3, 2013 in U.S. Appl. No. 12/264,416.
USPTO; Notice of Allowance dated Jun. 23, 2013 in U.S. Appl. No. 12/264,416.
USPTO; Office Action dated May 22, 2009 in U.S. Appl. No. 12/369,362.
USPTO; Final Office Action dated Dec. 14, 2009 in U.S. Appl. No. 12/369,362.
USPTO; Final Office Action dated Jun. 11, 2010 in U.S. Appl. No. 12/395,430.
USPTO; Office Action dated Nov. 24, 2010 in U.S. Appl. No. 12/395,430.
USPTO; Final Office Action dated Apr. 6, 2011 in U.S. Appl. No. 12/395,430.
USPTO; Office Action dated Aug. 18, 2011 in U.S. Appl. No. 12/395,430.
USPTO; Final Office Action dated Dec. 13, 2011 in U.S. Appl. No. 12/395,430.
USPTO; Notice of Allowance dated Sep. 20, 2012 in U.S. Appl. No. 12/395,430.
USPTO; Advisory Action dated Feb. 22, 2012 in U.S. Appl. No. 12/395,430.
USPTO; Office Action dated Sep. 29, 2010 in U.S. Appl. No. 12/758,509.
USPTO; Final Office Action dated May 11, 2011 in U.S. Appl. No. 12/758,509.
USPTO; Office Action dated Feb. 1, 2012 in U.S. Appl. No. 12/853,201.
USPTO; Final Office Action dated Jul. 3, 2012 in U.S. Appl. No. 12/853,201.
USPTO; Notice of Allowance dated Jan. 31, 2013 in U.S. Appl. No. 12/853,201.
USPTO; Office Action dated Jan. 3, 2013 in U.S. Appl. No. 12/853,238.
USPTO; Office Action dated Dec. 18, 2013 in U.S. Appl. No. 12/853,238.
USPTO; Final Office Action dated May 19, 2014 in U.S. Appl. No. 12/853,238.
USPTO; Office Action dated Mar. 31, 2015 in U.S. Appl. No. 12/853,238.
USPTO; Office Action dated Jan. 20, 2016 in U.S. Appl. No. 12/853,238.
USPTO; Office Action dated Feb. 27, 2012 in U.S. Appl. No. 12/853,253.
USPTO; Ex Parte Quayle Action dated Jun. 27, 2012 in U.S. Appl. No. 12/853,253.
USPTO; Notice of Allowance dated Oct. 2, 2012 in U.S. Appl. No. 12/853,253.
USPTO; Office Action dated Mar. 12, 2012 in U.S. Appl. No. 12/853,255.
USPTO; Final Office Action dated Jul. 24, 2012 in U.S. Appl. No. 12/853,255.
USPTO; Office Action dated Jan. 18, 2013 in U.S. Appl. No. 12/853,255.
USPTO; Notice of Allowance dated Jun. 20, 2013 in U.S. Appl. No. 12/853,255.
USPTO; Office Action dated Apr. 19, 2012 in U.S. Appl. No. 12/853,268.
USPTO; Final Office Action dated Sep. 17, 2012 in U.S. Appl. No. 12/853,268.
USPTO; Notice of Allowance dated Nov. 21, 2012 in U.S. Appl. No. 12/853,268.
USPTO; Office Action dated Aug. 1, 2013 in U.S. Appl. No. 12/877,988.
USPTO; Notice of Allowance dated Dec. 24, 2013 in U.S. Appl. No. 12/877,988.
USPTO; Office Action dated May 29, 2012 in U.S. Appl. No. 12/878,984.
USPTO; Office Action dated Oct. 3, 2012 in U.S. Appl. No. 12/878,984.
USPTO; Final Office Action dated Jan. 25, 2013 in U.S. Appl. No. 12/878,984.
USPTO; Notice of Allowance dated Mar. 28, 2013 in U.S. Appl. No. 12/878,984.
USPTO; Office Action dated Sep. 22, 2011 in U.S. Appl. No. 12/880,027.
USPTO; Final Office Action dated Feb. 16, 2012 in U.S. Appl. No. 12/880,027.
USPTO; Office Action dated Dec. 14, 2012 in U.S. Appl. No. 12/880,027.
USPTO; Final Office Action dated Jul. 11, 2013 in U.S. Appl. No. 12/880,027.
USPTO; Office Action dated Jul. 16, 2014 in U.S. Appl. No. 12/880,027.
USPTO; Ex Parte Quayle Office Action dated Dec. 19, 2014 in U.S. Appl. No. 12/880,027.
USPTO; Notice of Allowance dated Apr. 8, 2015 in U.S. Appl. No. 12/880,027.
USPTO; Office Action dated Dec. 18, 2013 in U.S. Appl. No. 12/895,796.
USPTO; Final Office Action dated Jun. 3, 2014 in U.S. Appl. No. 12/895,796.
USPTO; Office Action dated Nov. 17, 2014 in U.S. Appl. No. 12/895,796.
USPTO; Office Action dated Sep. 1, 2015 in U.S. Appl. No. 12/895,796.
USPTO; Office Action dated Aug. 25, 2011 in U.S. Appl. No. 13/047,719.
USPTO; Final Office Action dated Dec. 16, 2011 in U.S. Appl. No. 13/047,719.
USPTO; Office Action dated Sep. 11, 2012 in U.S. Appl. No. 13/047,719.
USPTO; Notice of Allowance dated Feb. 28, 2013 in U.S. Appl. No. 13/047,719.
USPTO; Office Action dated Aug. 25, 2011 in U.S. Appl. No. 13/047,747.
USPTO; Final Office Action dated Feb. 7, 2012 in U.S. Appl. No. 13/047,747.
USPTO; Notice of Allowance dated Apr. 18, 2012 in U.S. Appl. No. 13/047,747.
USPTO; Office Action dated Dec. 13, 2012 in U.S. Appl. No. 13/047,747.
USPTO; Notice of Allowance dated Apr. 3, 2013 in U.S. Appl. No. 13/047,747.
USPTO; Office Action dated Apr. 12, 2013 in U.S. Appl. No. 13/106,853.
USPTO; Notice of Allowance dated Aug. 23, 2013 in U.S. Appl. No. 13/106,853.

(56) References Cited

OTHER PUBLICATIONS

USPTO; Office Action dated Apr. 18, 2012 in U.S. Appl. No. 13/252,145.
USPTO; Final Office Action dated Sep. 17, 2012 in U.S. Appl. No. 13/252,145.
USPTO; Notice of Allowance dated Nov. 30, 2012 in U.S. Appl. No. 13/252,145.
USPTO; Office Action dated Sep. 18, 2013 in U.S. Appl. No. 13/752,312.
USPTO; Final Office Action dated Jan. 27, 2014 in U.S. Appl. No. 13/752,312.
USPTO; Final Office Action dated May 23, 2014 in U.S. Appl. No. 13/752,312.
USPTO; Notice of Allowance dated Dec. 17, 2014 in U.S. Appl. No. 13/752,312.
USPTO; Office Action dated Sep. 6, 2013 in U.S. Appl. No. 13/725,383.
USPTO; Office Action dated Oct. 24, 2013 in U.S. Appl. No. 13/725,383.
USPTO; Office Action dated Mar. 3, 2015 in U.S. Appl. No. 13/725,383.
USPTO; Office Action dated Nov. 20, 2015 in U.S. Appl. No. 13/725,383.
USPTO; Office Action dated Sep. 11, 2013 in U.S. Appl. No. 13/756,468.
USPTO; Notice of Allowance dated Febiumy 3, 2014 in U.S. Appl. No. 13/756,468.
USPTO; Office Action dated Sep. 10, 2014 in U.S. Appl. No. 13/791,952.
USPTO; Office Action dated Dec. 15, 2015 in U.S. Appl. No. 13/800,460.
USPTO; Office Action dated Sep. 23, 2014 in U.S. Appl. No. 13/843,947.
USPTO; Office Action dated Nov. 28, 2014 in U.S. Appl. No. 13/843,947.
USPTO; Final Office dated Apr. 10, 2015 in U.S. Appl. No. 13/843,947.
USPTO; Final Office Action dated Sep. 11, 2015 in U.S. Appl. No. 13/843,947.
USPTO; Ex Parte Quayle Action dated Jan. 25, 2016 in U.S. Appl. No. 13/843,947.
USPTO; Office Action dated Sep. 22, 2014 in U.S. Appl. No. 13/830,031.
USPTO; Notice of Allowance dated Jan. 30, 2015 in U.S. Appl. No. 13/830,031.
USPTO; Office Action dated Sep. 25, 2014 in U.S. Appl. No. 13/838,601.
USPTO; Final Office Action dated Mar. 3, 2015 in U.S. Appl. No. 13/838,601.
USPTO; Office Action dated Jul. 24, 2015 in U.S. Appl. No. 13/838,601.
USPTO; Office Action dated Aug. 14, 2014 in U.S. Appl. No. 13/791,889.
USPTO; Final Office Action dated Dec. 5, 2014 in U.S. Appl. No. 13/791,889.
USPTO; Office Action dated Sep. 15, 2014 in U.S. Appl. No. 13/797,616.
USPTO; Notice of Allowance dated Feb. 4, 2015 in 13/797,616.
USPTO; Restriction Requirement dated Sep. 17, 2014 in U.S. Appl. No. 13/801,907.
USPTO; Office Action dated Dec. 9, 2014 in U.S. Appl. No. 13/801,907.
USPTO; Notice of Allowance dated Jun. 5, 2015 in U.S. Appl. No. 13/801,907.
USPTO; Supplemental Notice of Allowance dated Oct. 2, 2015 in U.S. Appl. No. 13/801,907.
USPTO; Office Action dated Jan. 9, 2015 in U.S. Appl. No. 13/802,040.
USPTO; Notice of Allowance dated Jul. 14, 2015 in U.S. Appl. No. 13/802,040.
USPTO; Restriction Requirement dated Sep. 17, 2014 in U.S. Appl. No. 13/802,203.
USPTO; Office Action dated Dec. 11, 2014 in U.S. Appl. No. 13/802,203.
USPTO; Office Action dated Jan. 12, 2016 in U.S. Appl. No. 13/802,203.
USPTO; Office Action dated Feb. 13, 2015 in U.S. Appl. No. 13/973,962.
USPTO; Final Office Action dated Jul. 16, 2015 in U.S. Appl. No. 13/973,962.
USPTO; Office Action dated Apr. 10, 2015 in U.S. Appl. No. 14/027,237.
USPTO; Notice of Allowance dated Jan. 15, 2016 in U.S. Appl. No. 14/027,237.
USPTO; Notice of Allowance dated Nov. 24, 2015 in U.S. Appl. No. 13/973,962.
USPTO; Final Office Action dated Aug. 20, 2015 in U.S. Appl. No. 14/027,237.
USPTO; Ex Parte Quayle Action dated Nov. 4, 2015 in U.S. Appl. No. 14/027,237.
USPTO; Restriction Requirement dated Jun. 25, 2015 in U.S. Appl. No. 13/841,938.
USPTO; Office Action dated Aug. 25, 2015 in U.S. Appl. No. 13/841,938.
USPTO; Final Office Action dated Jul. 10, 2015 in U.S. Appl. No. 12/853,238.
USPTO; Final Office Action dated Jul. 10, 2015 in U.S. Appl. No. 13/725,383.
USPTO; Office Action dated Jul. 30, 2015 in U.S. Appl. No. 13/841,594.
USPTO; Final Office Action dated Feb. 23, 2016 in U.S. Appl. No. 13/841,594.
USPTO; Office Action dated Dec. 17, 2015 in U.S. Appl. No. 14/286,442.
USPTO; Office Action dated Dec. 23, 2015 in U.S. Appl. No. 14/662,100.
USPTO; Office Action dated Dec. 14, 2015 in U.S. Appl. No. 14/687,806.
USPTO; Office Action dated Dec. 18, 2015 in U.S. Appl. No. 14/689,879.
USPTO; Office Action dated Dec. 15, 2015 in U.S. Appl. No. 14/690,064.
USPTO; Office Action dated Dec. 31, 2015 in U.S. Appl. No. 14/690,099.
USPTO; Office Action dated Jan. 4, 2016 in U.S. Appl. No. 14/712,435.
USPTO; Office Action dated Feb. 11, 2016 in U.S. Appl. No. 14/690,174.
USPTO; Office Action dated Feb. 25, 2016 in U.S. Appl. No. 13/841,938.
USPTO; Notice of Allowance dated Mar. 8, 2016 in U.S. Appl. No. 13/973,962.
USPTO; Office Action dated Mar. 10, 2016 in U.S. Appl. No. 14/690,218.
USPTO; Notice of Allowance dated Mar. 11, 2016 in U.S. Appl. No. 13/843,947.
USPTO; Notice of Allowance dated Apr. 11, 2016 in U.S. Appl. No. 14/690,064.
USPTO; Notice of Allowance dated Apr. 12, 2016 in U.S. Appl. No. 14/027,237.
USPTO; Final Office Action dated May 2, 2016 in U.S. Appl. No. 14/687,806.
USPTO; Office action dated May 4, 2016 in U.S. Appl. No. 14/923,296.
USPTO; Notice of Allowance dated May 6, 2016 in U.S. Appl. No. 13/725,383.
USPTO; Notice of Allowance dated May 8, 2016 in U.S. Appl. No. 13/802,203.
USPTO; Office Action dated May 9, 2016 in U.S. Appl. No. 14/804,157.
USPTO; Office Action dated May 19, 2016 in U.S. Appl. No. 14/745,845.

(56) References Cited

OTHER PUBLICATIONS

USPTO; Office Action dated May 27, 2016 in U.S. Appl. No. 14/918,471.
USPTO; Office Action dated Jun. 6, 2016 in U.S. Appl. No. 14/808,935.
USPTO; Final Office Action dated Jun. 15, 2016 in U.S. Appl. No. 14/689,879.
USPTO; Notice of Allowance dated Jul. 7, 2016 in U.S. Appl. No. 14/804,157.
USPTO; Notice of Allowance dated Jul. 7, 2016 in U.S. Appl. No. 14/690,218.
USPTO; Notice of Allowance dated Jul. 7, 2016 in U.S. Appl. No. 14/690,099.
USPTO; Notice of Allowance dated Jul. 7, 2016 in U.S. Appl. No. 14/662,100.
USPTO; Notice of Allowance dated Jul. 20, 2016 in U.S. Appl. No. 14/715,435.
USPTO; Final Office Action dated Jul. 28, 2016 in U.S. Appl. No. 13/800,460.
USPTO; Office Action dated Aug. 1, 2016 in U.S. Appl. No. 15/153,735.
USPTO; Final Office Action dated Aug. 10, 2016 in U.S. Appl. No. 12/853,238.
USPTO; Office Action dated Aug. 15, 2016 in U.S. Appl. No. 14/811,655.
USPTO; Office Action dated Aug. 17, 2016 in U.S. Appl. No. 14/959,758.
USPTO; Final Office Action dated Aug. 26, 2016 in U.S. Appl. No. 14/923,296.
USPTO; Office action dated Aug. 29, 2016 in U.S. Appl. No. 14/687,806.
USPTO; Final Office Action dated Sep. 15, 2016 in U.S. Appl. No. 14/745,845.
USPTO; Office Action dated Sep. 15, 2016 in U.S. Appl. No. 14/746,593.
USPTO; Office Action dated Sep. 22, 2016 in Serial No. 13/841,594.
USPTO; Notice of Allowance dated Sep. 28, 2016 in U.S. Appl. No. 14/918,471.
USPTO; Office Action dated Oct. 11, 2016 in U.S. Appl. No. 13/841,938.
USPTO; Office Action dated Oct. 27, 2016 in U.S. Appl. No. 14/689,879.
USPTO; Notice of Allowance dated Nov. 25, 2016 in U.S. Appl. No. 15/153,735.
USPTO; Notice of Allowance dated Nov. 29, 2016 in U.S. Appl. No. 14/808,935.
USPTO; Notice of Allowance dated Dec. 27, 2016 in U.S. Appl. No. 14/687,806.
USPTO; Notice of Allowance dated Dec. 30, 2016 in U.S. Appl. No. 14/923,296.
USPTO; Notice of Allowance dated Mar. 13, 2017 in U.S. Appl. No. 14/923,296.
USPTO; Final Office Action dated Mar. 17, 2017 in U.S. Appl. No. 14/811,655.
USPTO; Office Action dated Mar. 17, 2017 in U.S. Appl. No. 14/880,998.
USPTO; Final Office Action dated Mar. 29, 2017 in U.S. Appl. No. 14/959,758.
USPTO; Final Office Action dated Apr. 3, 2017 in U.S. Appl. No. 14/745,845.
USPTO; Office Action dated Apr. 11, 2017 in U.S. Appl. No. 14/959,811.
USPTO; Office Action dated Apr. 12, 2017 in U.S. Appl. No. 14/746,593.
USPTO; Office Action dated Apr. 20, 2017 in U.S. Appl. No. 14/959,653.
USPTO; Final Office Action dated May 10, 2017 in U.S. Appl. No. 14/689,879.
USPTO; Final Office Action dated Jun. 15, 2017 in U.S. Appl. No. 13/841,938.
USPTO; Office Action dated Aug. 1, 2017 in U.S. Appl. No. 14/811,655.
USPTO; Office Action dated Aug. 18, 2017 in U.S. Appl. No. 14/745,845.
USPTO; Office Action dated Aug. 22, 2017 in U.S. Appl. No. 15/194,544.
USPTO; Notice of Allowance dated Aug. 31, 2017 in U.S. Appl. No. 14/959,653.
USPTO; Office Action dated Sep. 1, 2017 in U.S. Appl. No. 14/689,879.
USPTO; Notice of Allowance dated Sep. 26, 2017 in U.S. Appl. No. 14/811,655.
USPTO; Final Office Action dated Sep. 26, 2017 in U.S. Appl. No. 14/959,811.
USPTO; Notice of Allowance dated Sep. 29, 2017 in U.S. Appl. No. 15/194,544.
USPTO; Non-Final Office Action dated Oct. 4, 2017 in U.S. Appl. No. 12/853,238.
USPTO; Non-Final Office Action dated Oct. 13, 2017 in U.S. Appl. No. 15/205,700.
USPTO; Non-Final Office Action dated Oct. 18, 2017 in U.S. Appl. No. 15/205,878.
USPTO; Notice of Allowance dated Oct. 20, 2017 in U.S. Appl. No. 13/800,460.
USPTO; Non-Final Office Action dated Nov. 1, 2017 in U.S. Appl. No. 15/209,660.
USPTO; Notice of Allowance dated Nov. 13, 2017 in U.S. Appl. No. 14/959,811.
USPTO; Non-Final Office Action dated Nov. 14, 2017 in U.S. Appl. No. 15/233,882.
USPTO; Notice of Allowance dated Nov. 16, 2017 in U.S. Appl. No. 15/194,544.
USPTO; Non-Final Office Action dated Nov. 16, 2017 in U.S. Appl. No. 15/233,946.
USPTO; Notice of Allowance dated Nov. 17, 2017 in U.S. Appl. No. 13/800,460.
USPTO; Non-Final Office Action dated Nov. 17, 2017 in U.S. Appl. No. 13/841,938.
USPTO; Non-Final Office Action dated Nov. 20, 2017 in U.S. Appl. No. 14/791,166.
USPTO; Non-Final Office Action dated Dec. 4, 2017 in U.S. Appl. No. 15/234,490.
USPTO; Non-Final Office Action dated Dec. 6, 2017 in U.S. Appl. No. 14/791,137.
USPTO; Notice of Allowance dated Dec. 6, 2017 in U.S. Appl. No. 14/959,653.
USPTO; Notice of Allowance dated Dec. 8, 2017 in U.S. Appl. No. 14/811,655.
USPTO; Notice of Allowance dated Dec. 12, 2017 in U.S. Appl. No. 14/959,811.
USPTO; Notice of Allowance dated Dec. 20, 2017 in U.S. Appl. No. 13/800,460.
USPTO; Non-Final Office Action dated Jan. 5, 2018 in U.S. Appl. No. 15/013,879.
USPTO; Notice of Allowance dated Jan. 5, 2018 in U.S. Appl. No. 15/194,544.
USPTO; Final Office Action dated Jan. 10, 2018 in U.S. Appl. No. 14/689,879.
USPTO; Final Office Action dated Jan. 17, 2018 in U.S. Appl. No. 14/745,845.
USPTO; Notice of Allowance dated Jan. 22. 2018 in U.S. Appl. No. 13/800,460.
USTPO; Notice of Allowance dated Feb. 8, 2018 in U.S. Appl. No. 15/194,544.
USPTO; Notice of Allowance dated Feb. 14, 2018 in U.S. Appl. No. 14/959,811.
USPTO; Notice of Allowance dated Mar. 12, 2018 in U.S. Appl. No. 15/209,660.
USPTO; Final Office Action dated Mar. 20, 2018 in U.S. Appl. No. 15/205,700.
USPTO; Final Office Action dated Apr. 25, 2018 in U.S. Appl. No. 15/233,946.

(56) References Cited

OTHER PUBLICATIONS

USPTO; Final Office Action dated Apr. 26, 2018 in U.S. Appl. No. 15/233,882.
USPTO; Notice of Allowance dated May 11, 2018 in U.S. Appl. No. 14/689,879.
USPTO; Final Office Action dated May 17, 2018 in U.S. Appl. No. 15/234,490.
USPTO; Non-Final Office Action dated May 18, 2018 in U.S. Appl. No. 14/745,845.
USPTO; Notice of Allowance dated May 22, 2018 in U.S. Appl. No. 15/435,884.
USPTO; Non-Final Office Action dated May 24, 2018 in U.S. Appl. No. 15/332,163.
USPTO; Non-Final Office Action dated May 30, 2018 in U.S. Appl. No. 15/371,086.
USPTO; Final Office Action dated Jun. 4, 2018 in U.S. Appl. No. 14/791,137.
USPTO; Notice of Allowance dated Jun. 5, 2018 in U.S. Appl. No. 13/841,938.
USPTO; Notice of Allowance dated Jun. 15, 2018 in U.S. Appl. No. 13/841,938.
USPTO; Non-Final Office Action dated Jun. 21, 2018 in U.S. Appl. No. 12/853,238.
USPTO; Notice of Allowance dated Jun. 22, 2018 in U.S. Appl. No. 13/841,938.
USPTO, Non-Final Office Action dated Jun. 28, 2018 in U.S. Appl. No. 14/791,166.
USPTO; Non-Final Office Action dated Jun. 28, 2018 in U.S. Appl. No. 15/431,596.
USPTO; Non-Final Office Action dated Jul. 2, 2108 in U.S. Appl. No. 15/619,289.
USPTO; Non-Final Office Action dated Jul. 6, 2018 in U.S. Appl. No. 15/902,444.
USPTO; Non-Final Office Action dated Jul. 11, 2018 in U.S. Appl. No. 15/339,624.
USPTO; Final Office Action dated Jul. 11, 2018 in U.S. Appl. No. 15/013,879.
USPTO; Notice of Allowance dated Jul. 25, 2018 in U.S. Appl. No. 14/689,879.
USPTO; Notice of Allowance dated Jul. 30, 2018 in U.S. Appl. No. 15/205,700.
USPTO; Notice of Allowance dated Aug. 6, 2018 in U.S. Appl. No. 15/233,882.
USPTO; Notice of Allowance dated Aug. 13, 2018 in U.S. Appl. No. 15/233,882.
USPTO; Notice of Allowance dated Aug. 13, 2018 in U.S. Appl. No. 15/233,946.
USPTO; Non-Final Office Action dated Aug. 31, 2018 in U.S. Appl. No. 15/234,490.
USPTO; Non-Final Office Action dated Sep. 11, 2018 in U.S. Appl. No. 15/406,515.
USPTO; Non-Final Office Action dated Sep. 20, 2018 in U.S. Appl. No. 15/804,903.
USPTO; Notice of Allowance dated Sep. 25, 2018 in U.S. Appl. No. 14/791,166.
USPTO; Non-Final Office Action dated Oct. 5, 2018 in U.S. Appl. No. 16/030,547.
USPTO; Notice of Allowance dated Oct. 12, 2018 in U.S. Appl. No. 14/791,166.
USPTO; Non-Final Office Action dated Oct. 25, 2018 in U.S. Appl. No. 14/791,137.
USPTO; Ex Parte Quayle Action dated Nov. 7, 2018 in U.S. Appl. No. 15/332,163.
USPTO; Non-Final Office Action date Nov. 7, 2018 in U.S. Appl. No. 15/205,700.
USPTO; Notice of Allowance dated Nov. 9, 2018 in U.S. Appl. No. 15/431,596.
USPTO; Final Office Action dated Nov. 30, 2018 in U.S. Appl. No. 14/745,845.
USPTO; Final Office Action dated Nov. 30, 2018 in U.S. Appl. No. 15/371,086.
USPTO; Final Office Action dated Dec. 4, 2018 in U.S. Appl. No. 15/619,289.
USPTO; Notice of Allowance dated Dec. 13, 2018 in U.S. Appl. No. 15/406,515.
USPTO; Notice of Allowance dated Jan. 3, 2019 in U.S. Appl. No. 15/341,596.
USPTO; Notice of Allowance dated Jan. 8, 2019 in U.S. Appl. No. 15/339,624.
USPTO; Notice of Allowance dated Jan. 18, 2019 in U.S. Appl. No. 15/234,490.
USPTO; Non-Final Office Action dated Jan. 23, 2019 in U.S. Appl. No. 16/144,873.
USPTO; Notice of Allowance dated Jan. 28, 2019 in U.S. Appl. No. 16/030,547.
USPTO; Notice of Allowance dated Feb. 12, 2019 in U.S. Appl. No. 15/332,163.
USPTO; Notice of Allowance dated Feb. 21, 2019 in U.S. Appl. No. 15/902,444.
USPTO; Final Office Action dated Feb. 25, 2019 in U.S. Appl. No. 12/853,238.
USPTO; Non-Final Office Action dated Feb. 27, 2019 in U.S. Appl. No. 15/013,879.
USPTO; Notice of Allowance dated Mar. 4, 2019 in U.S. Appl. No. 15/205,700.
USPTO; Notice of Allowance dated Mar. 13, 2019 in U.S. Appl. No. 14/745,845.
USPTO; Notice of Allowance dated Mar. 13, 2019 in U.S. Appl. No. 15/902,444.
USPTO; Notice of Allowance dated Mar. 15, 2019 in U.S. Appl. No. 16/030,547.
USPTO; Final Office Action dated Mar. 18, 2019 in U.S. Appl. No. 14/791,137.
USPTO; Notice of Allowance dated Mar. 18, 2019 in U.S. Appl. No. 15/205,700.
USPTO; Notice of Allowance dated Mar. 19, 2019 in U.S. Appl. No. 15/332,163.
USPTO; Notice of Allowance dated Mar. 20, 2019 in U.S. Appl. No. 15/234,490.
USPTO; Notice of Allowance dated Mar. 21, 2019 in U.S. Appl. No. 12/853,238.
USPTO; Notice of Allowance dated Apr. 5, 2019 in U.S. Appl. No. 15/902,444.
USPTO; Notice of Allowance dated Apr. 23, 2019 in U.S. Appl. No. 15/234,490.
USPTO; Notice of Allowance dated Apr. 18, 2019 in U.S. Appl. No. 15/205,700.
USPTO; Notice of Allowance dated Apr. 19, 2019 in U.S. Appl. No. 15/332,163.
USPTO; Office Action dated Jun. 12, 2019 in U.S. Appl. No. 15/371,086.
USPTO; Office Action dated Jun. 13, 2019 in U.S. Appl. No. 15/804,903.
USPTO; Office Action dated Jun. 27, 2019 in U.S. Appl. No. 15/849,479.
USPTO; Office Action dated Aug. 2, 2019 in U.S. Appl. No. 16/415,271.
USPTO; Final Office Action dated Sep. 11, 2019 in U.S. Appl. No. 16/144,873.
USPTO; Ex Parte Quayle Action dated Jun. 5, 2019 in U.S. Appl. No. 15/619,289.
USPTO; Notice of Allowance dated Aug. 14, 2019 in U.S. Appl. No. 15/619,289.
USPTO; Notice of Allowance dated Jul. 25, 2019 in U.S. Appl. No. 14/791,137.
USPTO; Final Office Action dated Aug. 6, 2019 in U.S. Appl. No. 15/013,879.
USPTO; Notice of Allowance dated Oct. 24, 2019 in U.S. Appl. No. 15/849,479.
USPTO; Notice of Allowance dated Nov. 14, 2019 in U.S. Appl. No. 15/371,086.

(56) References Cited

OTHER PUBLICATIONS

USPTO; Notice of Allowance dated Dec. 30, 2019 in U.S. Appl. No. 16/144,873.
USPTO; Non-Final Office Action dated Jan. 8, 2020 in the U.S. Appl. No. 15/013,879.
USPTO; Notice of Allowance dated Feb. 10, 2020 in the U.S. Appl. No. 16/415,271.
USPTO; Notice of Allowance dated Mar. 3, 2020 in the U.S. Appl. No. 15/804,903.
USPTO; Non-Final Office Action dated May 4, 2020 in the U.S. Appl. No. 15/916,089.
USPTO; Final Office Action dated May 11, 2020 in the U.S. Appl. No. 15/013,879.
USPTO; Restriction Requirement dated Oct. 1, 2020 in the U.S. Appl. No. 16/195,678.
USPTO; Final Office Action dated Oct. 8, 2020 in the U.S. Appl. No. 15/916,089.
USPTO; Notice of Allowance dated Nov. 18, 2020 in the U.S. Appl. No. 15/013,879.
USPTO; Non-Final Office Action dated Oct. 13, 2020 in the U.S. Appl. 16/862,333.
USPTO; Non-Final Office Action dated Feb. 1, 2021 in the U.S. Appl. No. 16/728,938.
USPTO; Non-Final Office Action dated Apr. 14, 2021 in the U.S. Appl. No. 16/533,383.
USPTO; Non-Final Office Action dated Apr. 13, 2021 in the U.S. Appl. No. 16/533,404.
USPTO; Non-Final Office Action dated Feb. 25, 2021 in the U.S. Appl. No. 15/916,089.
UPTO; Non-Final Office Action dated Apr. 15, 2021 in the U.S. Appl. No. 16/413,142.
USPTO; Non-Final Office Action dated Feb. 23, 2021 in the U.S. Appl. No. 16/728,966.
USPTO; Non-Final Office Action dated Mar. 22, 2021 in the U.S. Appl. 16/728,978.
USPTO; Notice of Allowance dated Apr. 19, 2021 in the U.S. Appl. No. 16/728,978.
USPTO; Non-Final Office Action dated Mar. 25, 2021 in the U.S. Appl. No. 16/729,009.
USPTO; Non-Final Office Action dated Apr. 2, 2021 in the U.S. Appl. No. 16/729,033.
USPTO; Non-Final OA dated Mar. 25, 2021 in the U.S. Appl. No. 16/790,734.
CIPO; Office Action dated Dec. 4, 2001 in Application No. 2,115,929.
CIPO; Office Action dated Apr. 22, 2002 in Application No. 2,115,929.
CIPO; Notice of Allowance dated Jul. 18, 2003 in Application No. 2,115,929.
CIPO; Office Action dated Jun. 30, 2003 in Application No. 2,176,475.
CIPO; Notice of Allowance dated Sep. 15, 2004 in Application No. 2,176,475.
CIPO; Office Action dated May 29, 2000 in Application No. 2,242,174.
CIPO; Office Action dated Feb. 22, 2006 in Application No. 2,244,251.
CIPO; Office Action dated Mar. 27, 2007 in Application No. 2,244,251.
CIPO; Notice of Allowance dated Jan. 15, 2008 in Application No. 2,244,251.
CIPO; Office Action dated Sep. 18, 2002 in Application No. 2,305,865.
CIPO; Notice of Allowance dated May 2, 2003 in Application No. 2,305,865.
EPO; Examination Report dated Oct. 6, 2008 in Application No. 08158682.
EPO; Office Action dated Jan. 26, 2010 in Application No. 08158682.
EPO; Office Action dated Feb. 15, 2011 in Application No. 08158682.
EPO; Search Report dated Nov. 9, 1998 in Application No. 98112356.
EPO; Office Action dated Feb. 6, 2003 in Application No. 99941032.
EPO; Office Action dated Aug. 20, 2004 in Application No. 99941032.
PCT; International Search Report or Declaration dated Nov. 15, 1999 in Application No. PCT/US1999/18178.
PCT; International Search Report or Declaration dated Oct. 9, 1998 in Application No. PCT/US1999/22440.

* cited by examiner

SECTION G-G

SECTION E-E

SECTION D-D

SECTION F-F

SECTION G-G

SECTION B-B

SECTION D-D

SECTION A-A

SECTION C-C

SECTION G-G

TENSIONED ROTOR SHAFT FOR MOLTEN METAL

CROSS-REFERENCE TO RELATED APPLICATIONS

This application is a continuation of, and claims priority to U.S. patent application Ser. No. 16/144,873, filed Sep. 27, 2018, and entitled "Tensioned Support Shaft and Other Molten Metal Devices" which is a continuation of, and claims priority to, U.S. patent application Ser. No. 15/406,515 (Now U.S. Pat. No. 10,267,314), filed Jan. 13, 2017, and entitled "Tensioned Support Shaft and Other Molten Metal Devices," which claims the benefit of U.S. Provisional Application Ser. No. 62/278,314, filed Jan. 13, 2016, and entitled "Tensioned Support Shaft and Other Molten Metal Devices," the contents of each of the foregoing applications, are incorporated herein by reference, to the extent such contents do not conflict with the present disclosure.

FIELD OF THE INVENTION

The invention relates to tensioned support shafts that may be used in various devices, particularly pumps for pumping molten metal.

BACKGROUND OF THE INVENTION

As used herein, the term "molten metal" means any metal or combination of metals in liquid form, such as aluminum, copper, iron, zinc and alloys thereof. The term "gas" means any gas or combination of gases, including argon, nitrogen, chlorine, fluorine, Freon, and helium, which are released into molten metal.

Known molten-metal pumps include a pump base (also called a housing or casing), one or more inlets (an inlet being an opening in the housing to allow molten metal to enter a pump chamber), a pump chamber of any suitable configuration, which is an open area formed within the housing, and a discharge, which is a channel or conduit of any structure or type communicating with the pump chamber (in an axial pump the chamber and discharge may be the same structure or different areas of the same structure) leading from the pump chamber to an outlet, which is an opening formed in the exterior of the housing through which molten metal exits the casing. An impeller, also called a rotor, is mounted in the pump chamber and is connected to a drive system. The drive shaft is typically an impeller shaft connected to one end of a motor shaft, the other end of the drive shaft being connected to an impeller. Often, the impeller (or rotor) shaft is comprised of graphite and/or ceramic, the motor shaft is comprised of steel, and the two are connected by a coupling. As the motor turns the drive shaft, the drive shaft turns the impeller and the impeller pushes molten metal out of the pump chamber, through the discharge, out of the outlet and into the molten metal bath. Most molten metal pumps are gravity fed, wherein gravity forces molten metal through the inlet and into the pump chamber as the impeller pushes molten metal out of the pump chamber. Other molten metal pumps do not include a base or support posts and are sized to fit into a structure by which molten metal is pumped. Most pumps have a metal platform, or super structure, that is either supported by a plurality of support posts attached to the pump base, or unsupported if there is no base. The motor is positioned on the superstructure, if a superstructure is used.

This application incorporates by reference the portions of the following publications that are not inconsistent with this disclosure: U.S. Pat. No. 4,598,899, issued Jul. 8, 1986, to Paul V. Cooper, U.S. Pat. No. 5,203,681, issued Apr. 20, 1993, to Paul V. Cooper, U.S. Pat. No. 5,308,045, issued May 3, 1994, by Paul V. Cooper, U.S. Pat. No. 5,662,725, issued Sep. 2, 1997, by Paul V. Cooper, U.S. Pat. No. 5,678,807, issued Oct. 21, 1997, by Paul V. Cooper, U.S. Pat. No. 6,027,685, issued Feb. 22, 2000, by Paul V. Cooper, U.S. Pat. No. 6,124,523, issued Sep. 26, 2000, by Paul V. Cooper, U.S. Pat. No. 6,303,074, issued Oct. 16, 2001, by Paul V. Cooper, U.S. Pat. No. 6,689,310, issued Feb. 10, 2004, by Paul V. Cooper, U.S. Pat. No. 6,723,276, issued Apr. 20, 2004, by Paul V. Cooper, U.S. Pat. No. 7,402,276, issued Jul. 22, 2008, by Paul V. Cooper, U.S. Pat. No. 7,507,367, issued Mar. 24, 2009, by Paul V. Cooper, U.S. Pat. No. 7,906,068, issued Mar. 15, 2011, by Paul V. Cooper, U.S. Pat. No. 8,075,837, issued Dec. 13, 2011, by Paul V. Cooper, U.S. Pat. No. 8,110,141, issued Feb. 7, 2012, by Paul V. Cooper, U.S. Pat. No. 8,178,037, issued May 15, 2012, by Paul V. Cooper, U.S. Pat. No. 8,361,379, issued Jan. 29, 2013, by Paul V. Cooper, U.S. Pat. No. 8,366,993, issued Feb. 5, 2013, by Paul V. Cooper, U.S. Pat. No. 8,409,495, issued Apr. 2, 2013, by Paul V. Cooper, U.S. Pat. No. 8,440,135, issued May 15, 2013, by Paul V. Cooper, U.S. Pat. No. 8,444,911, issued May 21, 2013, by Paul V. Cooper, U.S. Pat. No. 8,475,708, issued Jul. 2, 2013, by Paul V. Cooper, U.S. patent application Ser. No. 12/895,796, filed Sep. 30, 2010, by Paul V. Cooper, U.S. patent application Ser. No. 12/877,988, filed Sep. 8, 2010, by Paul V. Cooper, U.S. patent application Ser. No. 12/853,238, filed Aug. 9, 2010, by Paul V. Cooper, U.S. patent application Ser. No. 12/880,027, filed Sep. 10, 2010, by Paul V. Cooper, U.S. patent application Ser. No. 13/752,312, filed Jan. 28, 2013, by Paul V. Cooper, U.S. patent application Ser. No. 13/756,468, filed Jan. 31, 2013, by Paul V. Cooper, U.S. patent application Ser. No. 13/791,889, filed Mar. 8, 2013, by Paul V. Cooper, U.S. patent application Ser. No. 13/791,952, filed Mar. 9, 2013, by Paul V. Cooper, U.S. patent application Ser. No. 13/841,594, filed Mar. 15, 2013, by Paul V. Cooper, and U.S. patent application Ser. No. 14/027,237, filed Sep. 15, 2013, by Paul V. Cooper.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Circulation pumps may be used in any vessel, such as in a reverbatory furnace having an external well. The well is usually an extension of the charging well, in which scrap metal is charged (i.e., added).

Standard transfer pumps are generally used to transfer molten metal from one structure to another structure such as a ladle or another furnace. A standard transfer pump has a riser tube connected to a pump discharge and supported by the superstructure. As molten metal is pumped it is pushed up the riser tube (sometimes called a metal-transfer conduit) and out of the riser tube, which generally has an elbow at its upper end, so molten metal is released into a different vessel from which the pump is positioned.

Gas-release pumps, such as gas-injection pumps, circulate molten metal while introducing a gas into the molten metal. In the purification of molten metals, particularly aluminum, it is frequently desired to remove dissolved gases such as hydrogen, or dissolved metals, such as magnesium. As is known by those skilled in the art, the removing of dissolved gas is known as "degassing" while the removal of magnesium is known as "demagging." Gas-release pumps may be used for either of both of these purposes or for any other application for which it is desirable to introduce gas into molten metal.

Gas-release pumps generally include a gas-transfer conduit having a first end that is connected to a gas source and a second end submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where molten metal enters the pump chamber. The gas may also be released into any suitable location in a molten metal bath.

Molten metal pump casings and rotors often employ a bearing system comprising ceramic rings wherein there are one or more rings on the rotor that align with rings in the pump chamber (such as rings at the inlet and outlet) when the rotor is placed in the pump chamber. The purpose of the bearing system is to reduce damage to the soft, graphite components, particularly the rotor and pump base, during pump operation.

Generally, a degasser (also called a rotary degasser) includes (1) an impeller shaft having a first end, a second end and a passage for transferring gas, (2) an impeller, and (3) a drive source for rotating the impeller shaft and the impeller. The first end of the impeller shaft is connected to the drive source and to a gas source and the second end is connected to the impeller.

Generally a scrap melter includes an impeller affixed to an end of a drive shaft, and a drive source attached to the other end of the drive shaft for rotating the shaft and the impeller. The movement of the impeller draws molten metal and scrap metal downward into the molten metal bath in order to melt the scrap. A circulation pump is preferably used in conjunction with the scrap melter to circulate the molten metal in order to maintain a relatively constant temperature within the molten metal.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, or other ceramic material capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Ceramic, however, is more resistant to corrosion by molten aluminum than graphite. It would therefore be advantageous to develop vertical members used in a molten metal device that are comprised of ceramic, but less costly than solid ceramic members, and less prone to breakage than normal ceramic.

SUMMARY OF THE INVENTION

The present invention relates to a vertical member used in a molten metal device. The member is comprised of a hollow ceramic outer shell that has tension applied along a longitudinal axis of a rod therein. When such tension is applied to the rod, the ceramic outer shell is much less prone to breakage. One type of vertical member that may employ the invention is a support post. The disclosure also relates to pump including such support posts and to other molten metal devices.

BRIEF DESCRIPTION OF THE DRAWINGS

FIGS. 5A-1, 5A-2 and FIGS. 5B-5R illustrate a support post and various components thereof in accordance with additional exemplary embodiments of the disclosure.

DETAILED DESCRIPTION OF PREFERRED EMBODIMENTS

For any device described herein, any of the components that contact the molten metal are preferably formed by a material that can withstand the molten metal environment. Preferred materials are oxidation-resistant graphite and ceramics, such as silicon carbide.

Figure 1:
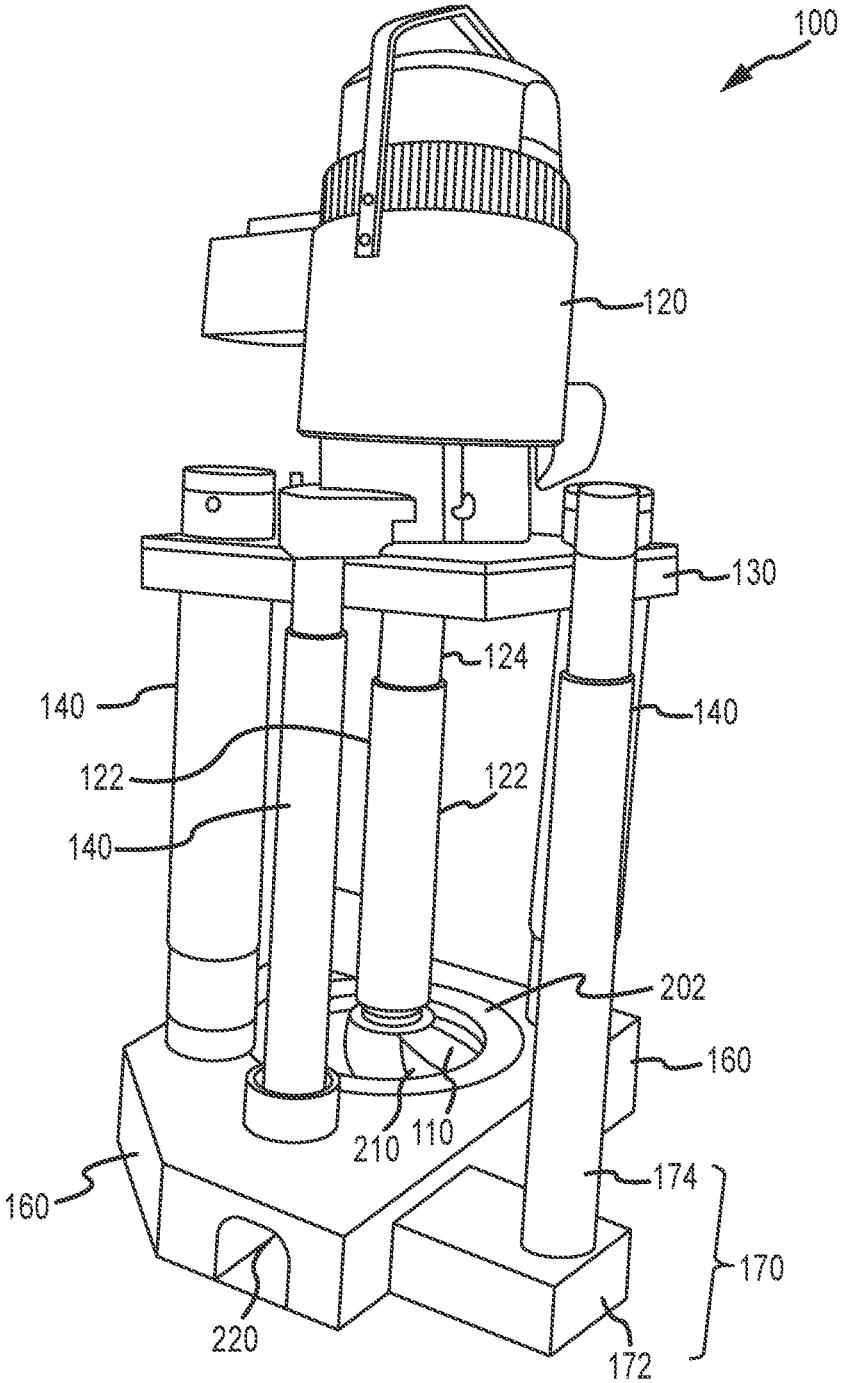
FIG. 1 is a perspective view of a pump for pumping molten metal, which may include rotor shaft and plurality of support posts, in accordance with various embodiments.

Reference will now be made in detail to the present exemplary embodiments of the invention, examples of which are illustrated in the accompanying drawings. FIG. 1 depicts a molten metal pump 100 according to exemplary embodiments of the disclosure. When in operation, pump 100 is typically positioned in a molten metal bath in a pump well, which is typically part of the open well of a reverbatory furnace. Pump 100 includes motor 120, superstructure 130, support shafts 140, drive shaft 122, rotor 110, base 160, and a gas transfer system 170. The gas transfer system 170 may comprise gas-transfer foot 172 and gas-transfer tube 174.

The components of pump 100 or portions thereof that are exposed to the molten metal (such as support shafts 140, drive shaft 122, rotor 110, base 160, gas-transfer foot 172 and gas-transfer tube 174) are preferably formed of structural refractory materials, which are resistant to degradation in the molten metal.

Pump 100 need not be limited to the structure depicted in FIG. 1, but can be any structure or device for pumping or otherwise conveying molten metal, such as the pump disclosed in U.S. Pat. No. 5,203,681 to Cooper, or an axial pump having an axial, rather than tangential, discharge. Preferred pump 100 includes a base 160 (e.g., a pump base) for being submersed in a molten metal bath. Pump base 160 preferably includes a generally nonvolute pump chamber 210, such as a cylindrical pump chamber or what has been called a "cut" volute, although pump base 160 may have any shape pump chamber suitable of being used, including a volute-shaped chamber. Pump chamber 210 may be constructed to have only one opening, either in its top or bottom, if a tangential discharge is used, since only one opening is required to introduce molten metal into pump chamber 210. Generally, pump chamber 210 has two coaxial openings of the same diameter and usually one is blocked by a flow blocking plate mounted on, or formed as part of, rotor 110. Base 160 further includes a tangential discharge 220 (although another type of discharge, such as an axial discharge may be used) in fluid communication with pump chamber 210.

In this embodiment, one or more support posts 140 connect base 160 to a superstructure 130 of pump 100 thus supporting superstructure 130. Pump 100 could be constructed so there is no physical connection between the base and the superstructure, wherein the superstructure is independently supported. The motor, drive shaft and rotor could be suspended without a superstructure, wherein they are supported, directly or indirectly, to a structure independent of the pump base.

Motor 120, which can be any structure, system or device suitable for driving pump 100, but is preferably an electric or pneumatic motor, is positioned on superstructure 130 and is connected to an end of a drive shaft 122. A drive shaft 122 can be any structure suitable for rotating an impeller, and preferably comprises a motor shaft (not shown) coupled to a rotor shaft. The motor shaft has a first end and a second end, wherein the first end of the motor shaft connects to motor 120 and the second end of the motor shaft connects to the coupling. Rotor shaft 124 has a first end and a second end, wherein the first end is connected to the coupling and the second end is connected to rotor (or impeller) 110.

Rotor 110 can be any rotor suitable for use in a molten metal pump and the term "rotor," as used in connection with this disclosure, means any device or rotor used in a molten metal device to displace molten metal.

Figure 2A:
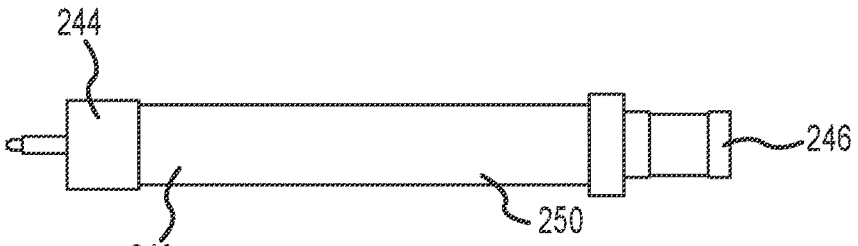
FIG. 2A is a profile view of a support post, in accordance with various embodiments.
Figure 2B:
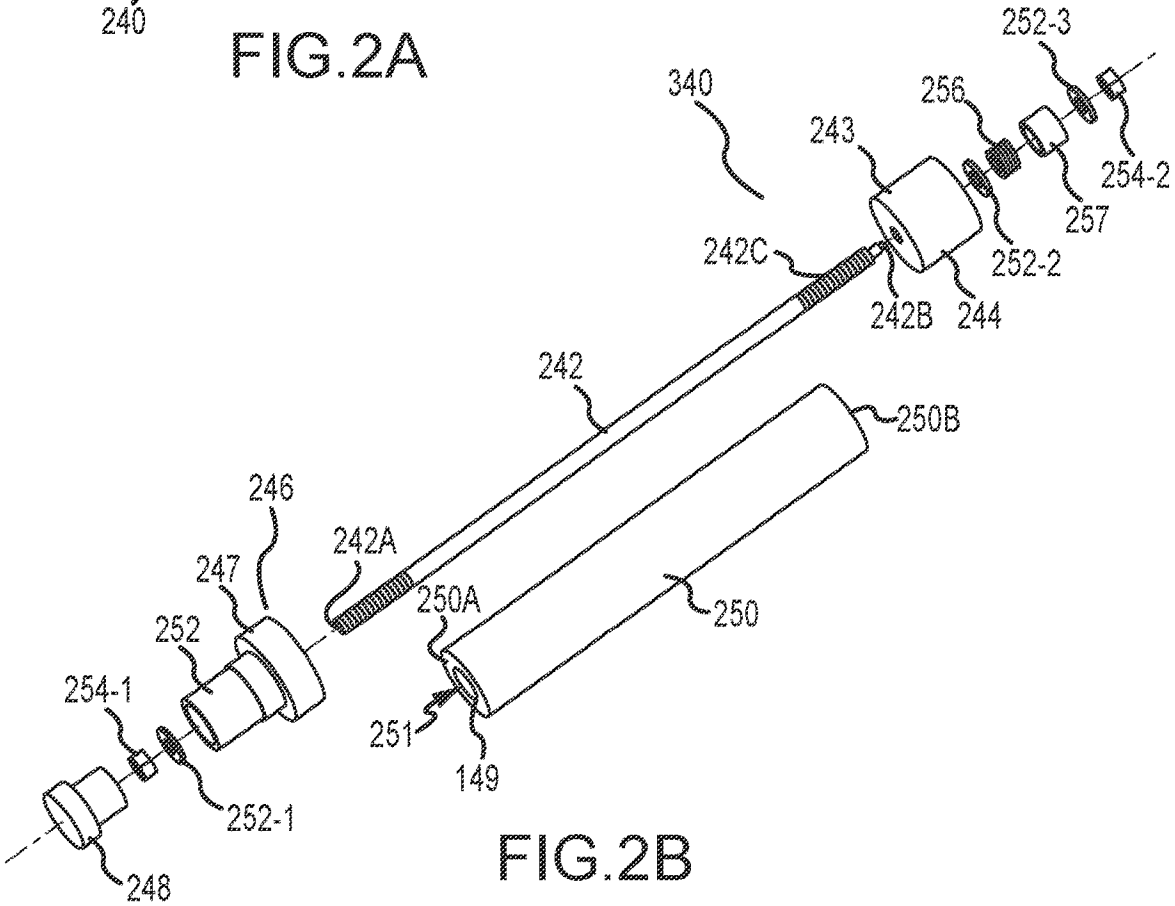
FIG. 2B is an exploded view of a support post, in accordance with various embodiments.

As described herein, support post (also referred to herein as support shaft) 140 may be a structure that is configured to support a motor and/or superstructure of a molten metal pump. In various embodiments and with reference to FIG. 2A and FIG. 2B, a support post 240, suitable for use as support post 140, comprises a tube 250, a tension rod 242, a bottom cap 246, and a top cap 244. Tension rod 242 may be disposed within a cavity 251 defined by the inner wall 149 of tube 250. Tension rod 242 may be attached at one and to bottom cap 246 and at its other end to top cap 244. In this embodiment, tension rod 242 is placed in tension by bottom cap 246 and top cap 244, creating a compressive load on tube 250.

Figure 3A:
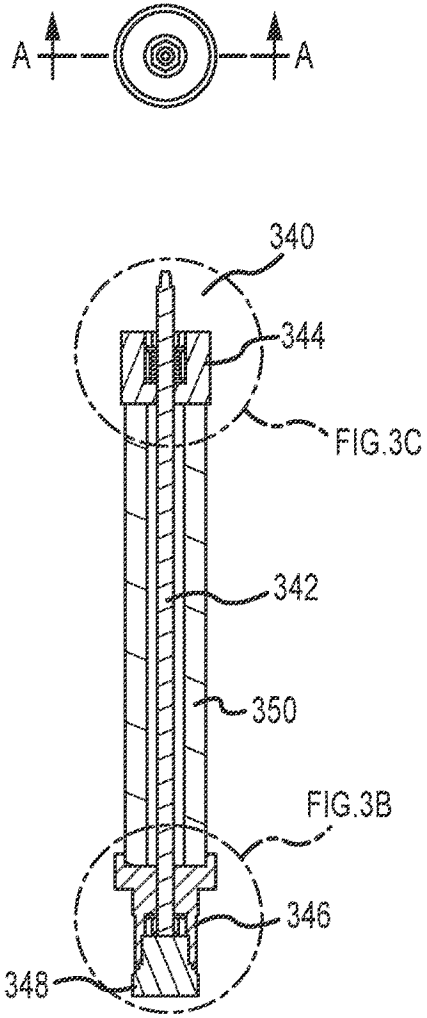
FIG. 3A is a cross sectional view of a support post, in accordance with various embodiments.
Figure 3C:
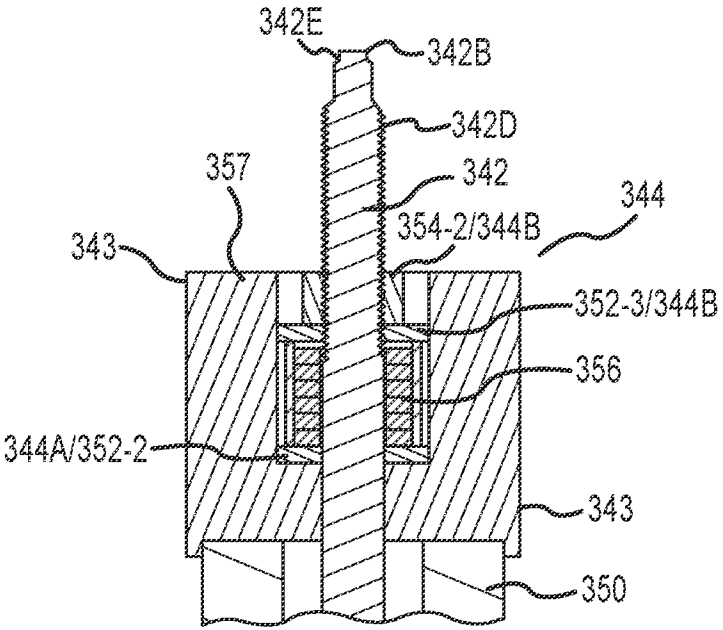
FIG. 3C is a cross sectional view of a top portion of a support post, in accordance with various embodiments.
Figure 3B:
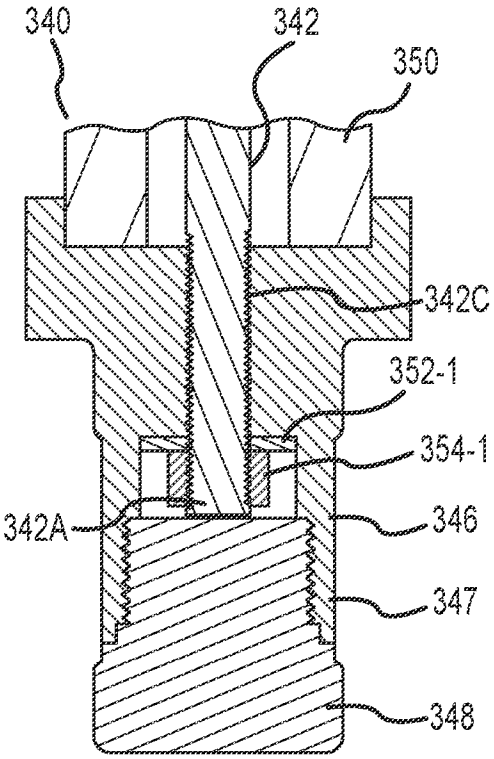
FIG. 3B is a cross sectional view of a bottom portion of a support post, in accordance with various embodiments.
Figure 3F:
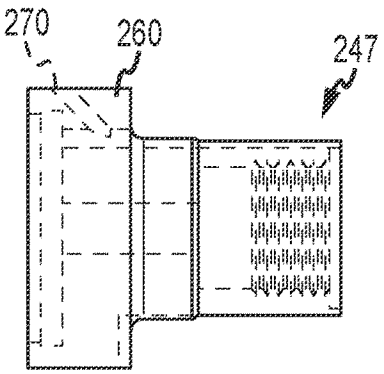
FIGS. 3D-3Z illustrate various components of exemplary support posts in accordance with various embodiments of the disclosure.
Figure 3G:
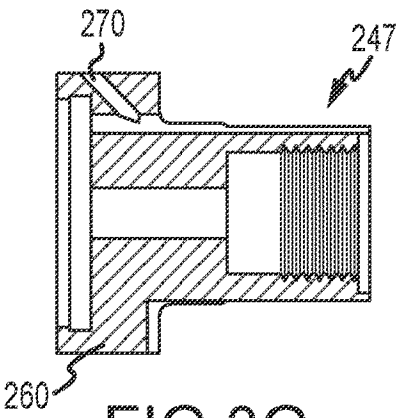
Figure 3D:
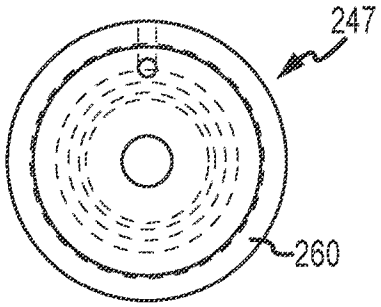
Figure 3E:
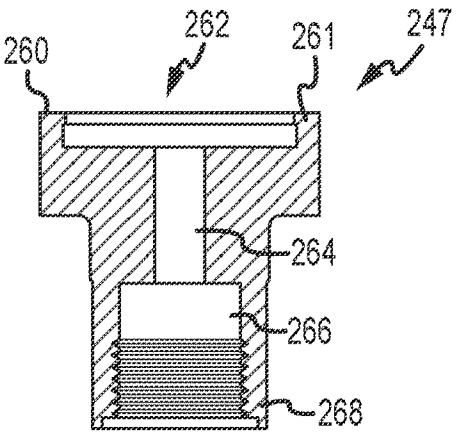
Figure 3J:
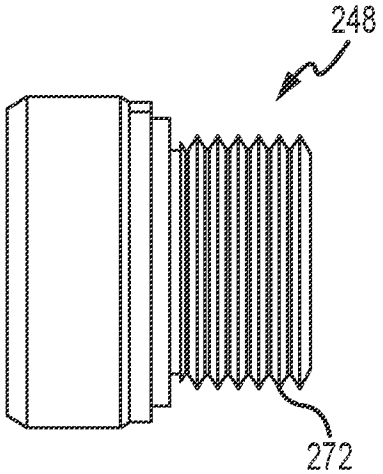
Figure 3K:
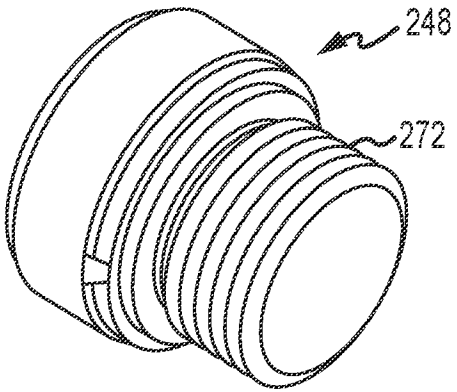
Figure 3H:
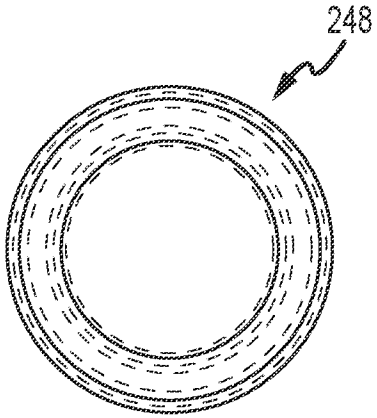
Figure 3I:
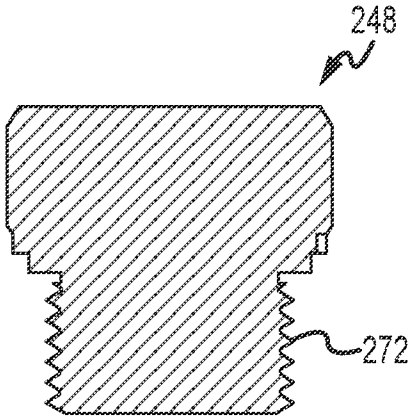
Figure 3M:
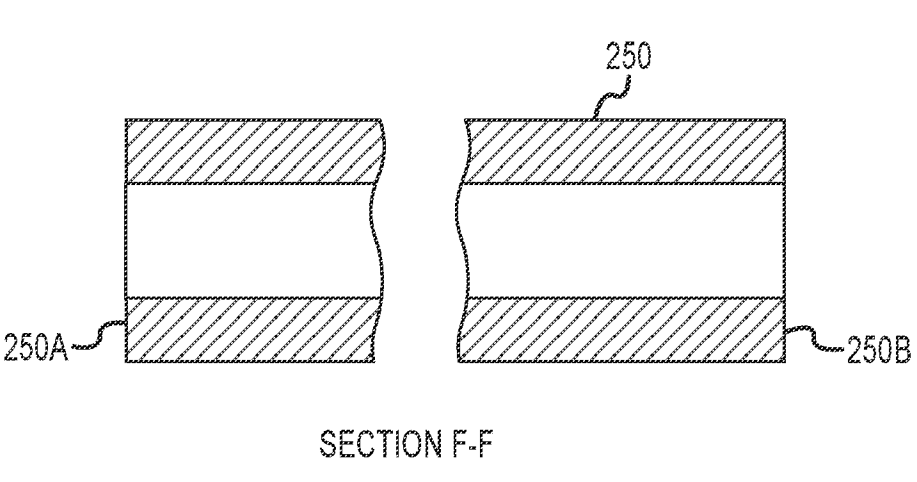
Figure 3L:
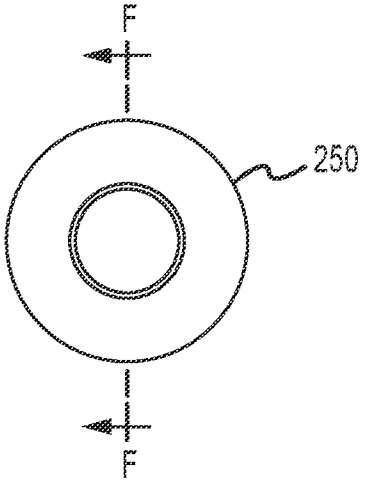
Figure 3N:
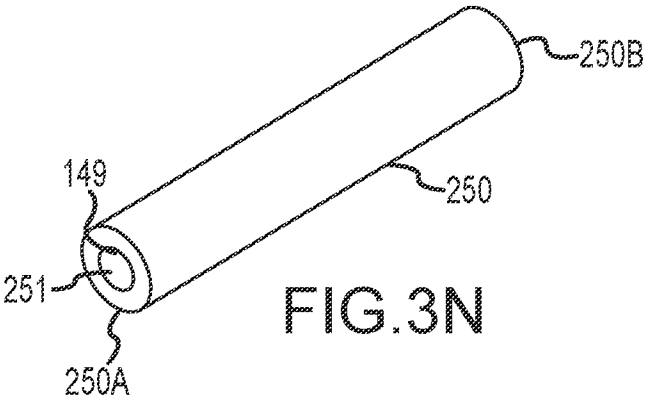

Tube 250, illustrated in more detail in FIGS. 3L-3N, preferably comprises a first end 250A and a second end 250B. Bottom cap 246 is configured to receive, engage, retain, and/or otherwise mate to the first end 250A of tube 250. Bottom cap 246 may also be operatively coupled to the first end 242A of tension rod 242. Top cap 244 may be configured to receive, engage, mate with, couple to, and/or otherwise receive the second end 250B of tube 250. Similarly, top cap 244 may be configured to operatively couple to, engage, and/or otherwise mate with the second end 242B of tension rod 242 and/or a portion of tension rod 242 adjacent to the second end 242B of tension rod 242.

In various embodiments, tube 250 may comprise inner or interior surface 149 that defines a hollow channel or cavity 251 within tube 250. As discussed herein, tension rod 242 may be installable within and/or housed by tube 250 within its hollow channel. Moreover, tension rod 242 may be separated from the interior surface of tube 250. In this regard, there may be a gap defined between tension rod 242 and the interior surface 149 of tube 250.

In various embodiments, tube 250 may be a homogeneous ceramic material. For example, tube 250 may be formed of a ceramic material such as, for example, silicon carbide.

Figure 3P:
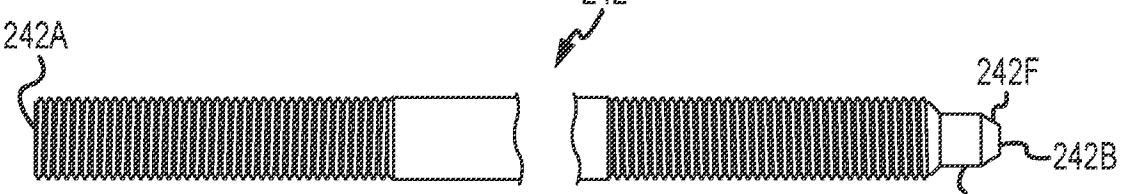
Figure 3O:
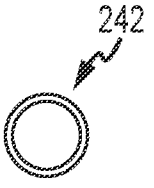
Figure 3Q:
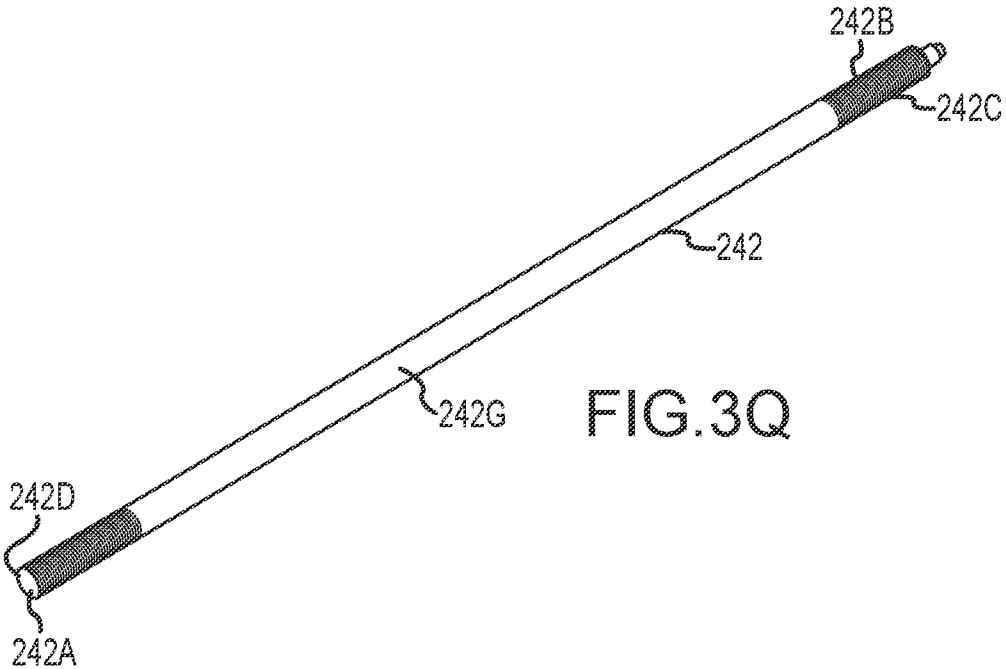

FIGS. 3O-3Q illustrate tension rod 242 in greater detail. Tension rod 242 can be formed of, for example, steel. Exemplary tension rods have a length of about 38.75 to about 45.75 inches and can have a diameter of about one inch. First end 242A can include a flat face 242D, while second end 242B can include a tip that includes a first portion 242E, which is cylindrical in shape and which has a smaller diameter than a middle section 242G, and a second section 242F that is frusto-conical in shape.

Top cap 244 and bottom cap 246 are preferably made of graphite. In various embodiments, and with reference to FIG. 2B, bottom cap 246 is in the form of an assembly. Bottom cap 246 comprises a housing 247 and a cover 248. Cover 248, may be operatively coupled to and/or may be installable within housing 247. For example, cover 248 may comprise a threaded portion 272 that is configured to thread into or otherwise engage with a receivable channel or cylinder within housing 247. Moreover, bottom cap 246 may comprise a fastener 254-1 and a washer 252-1. Fastener 254-1 and/or washer 252-1 is configured to engage the first end 242A of tension rod 242.

Bottom cap 246 and portions thereof are illustrated in greater detail in FIGS. 3D-3K. Housing 247 includes a top portion 260 including a top surface 261 having a recess 262 formed therein for receiving tube 250, a channel 264 for receiving tension rod 242, and an opening 266 for receiving cover 248 through a bottom portion 268 of housing 247. Recess 262, and channel 264 and opening 266 can be coaxial. As illustrated in FIG. 3E. a portion of opening 266 can be threaded, so as to enable engagement with threaded portion 272 of cover 248. Housing 247 can also include a cavity 270.

Figure 3T:
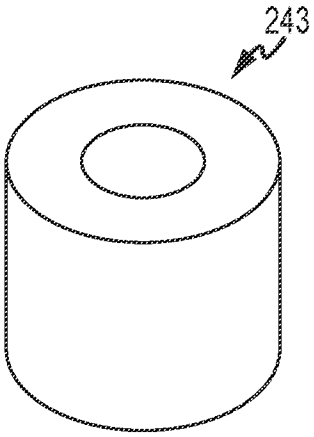
Figure 3R:
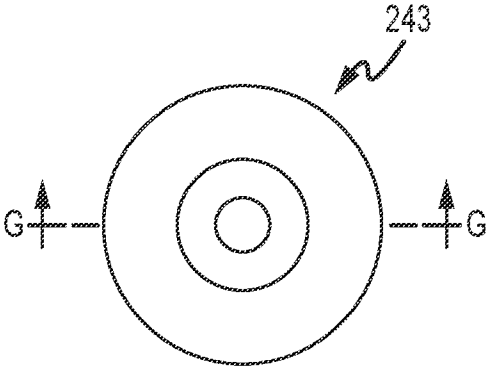
Figure 3S:
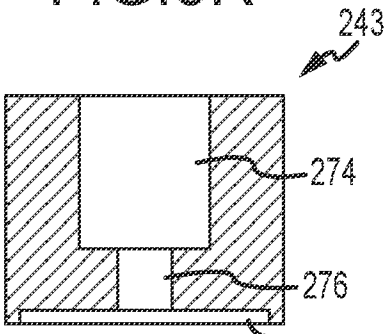
Figure 3V:
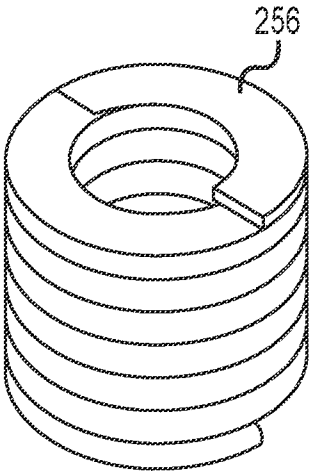
Figure 3U:
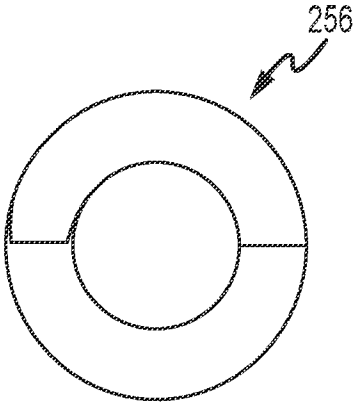
Figure 3W:
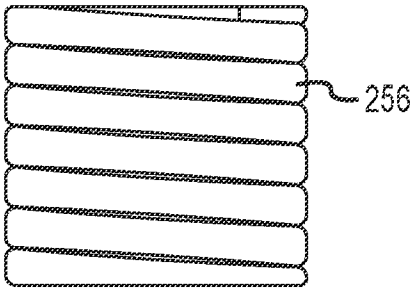
Figure 3Y:
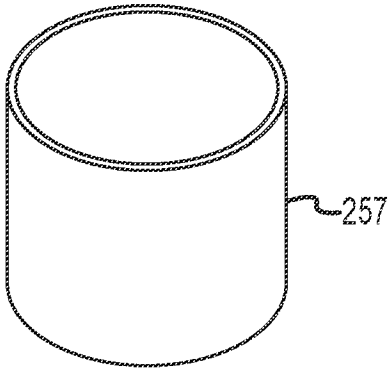
Figure 3X:
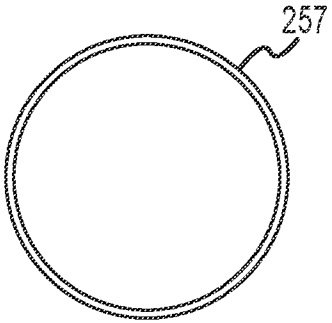
Figure 3Z:
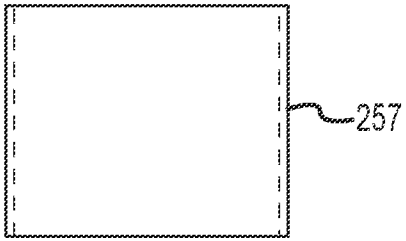

In various embodiments, top cap 244 is an assembly comprising housing 243 and spring 256 (illustrated in more detail in FIGS. 3U-3W). Spring 256 is installable within housing 243 of top cap 244. Second end 242B of tension rod 242 is configured to pass through and protrude from housing 243 of top cap 244. Spring 256 is installable over second end 242B of tension rod 242. In this regard, spring 256 is preferably configured to add tension to rod 242. Top cap 244 may further comprise a spring cover 257 (illustrated in more detail in FIGS. 3X-3Z), one or more washers including, for example, washer 252-2 and washer 252-3, and a fastener 254-2. Spring cover 257 as shown is installable over spring 256. One or more washers such as, for example, washer 252-2 and washer 252-3 may be installable on either side of spring cover 257. In this regard, washer 252-2 and/or washer 252-3 are configured to retain spring 256 within spring cover 257. Moreover, fastener 254-2 may be configured to engage and/or may be installable on the second end 242B of tension rod 242. Second end 242B of tension rod 242 may comprise a threaded portion 242C. Fastener 254-2 may be configured to engage and/or may be installable on the threaded portion 242C. Fastener 254-2 may also be configured to seat against and/or retain one or more of washer 252-2, washer 252-3, spring 256, and/or spring cover 257. In this regard, the assembly within top cap 244 is preferably configured to create a load on tension rod 242 thus creating a compressive load on tube 250.

FIGS. 3R-3T illustrate housing 243 in greater detail. Housing 243 includes a first opening 274, a passage 276, and a second opening 278, all of which can be coaxial. Recess 243 can be configured to receive a portion of tube 250, passage 276 can be configured to receive tension rod 242 therethrough, and recess 274 can be configured to receive washer 252-2, spring 256, spring cover 257, washer 252-3, and fastener 254-2.

In various embodiments, and with reference to FIG. 3A, FIG. 3B, and FIG. 3C, a support post 340, which may be the same or similar to support post 240, may comprise portions that are self-contained. For example, bottom cap 346 may create a self-contained assembly when tube 350 is installed with and/or engages bottom cap 346. In this regard, bottom cap 346 may be configured to isolate a tension rod 342 from a molten metal environment when support post 340 is installed on a molten metal pump. In operation, portions of support post 340 would be submerged within a molten metal bath. In order to prevent corrosion of tension rod 342 (which can be the same as or similar t tension rod 242), tube 350 (which can be the same as or similar to tube 250) and bottom cap 346 may be configured to form a liquid tight assembly that prevents molten metal (e.g., molten aluminum) from reaching tension rod 342.

In various embodiments, and as discussed herein, bottom cap 346 may comprise various parts including washers such as, for example, washer 352-1 and fasteners such as, for example, fastener 354-1. These washers and fasteners may be separately removable components or they may be integrally formed within one or more components of bottom cap 346. For example, washer 352-1 may be integrally formed within housing 347. In this regard, a first end 342A of tension rod 342 may be configured to pass through housing 347 and/or washer 352-1. Moreover, the first end 342A of tension rod 342 may comprise a threaded portion 342C that threads into and/or threads through housing 347 and/or washer 352-1. Housing 347 and/or cover 348 may also comprise and/or may be configured with an integrally formed fastener 354-1. In this regard, first end 342A of tension rod 342 may be configured to thread through the integral fastener 354-1 and/or may be capable of having the integral fastener threaded on the threaded portion 342C of the first end 342A of tension rod 342.

In various embodiments, top cap 344 may be an assembly that is configured to receive a threaded portion 342D of a second end 342B of tension rod 342. Top cap 344 may comprise various components including, for example, washers 352-2 and 352-3, fastener 354-2, spring 356, and/or spring cover 357. One or more of these elements may be integrally formed within top cap 344. For example, washer 352-2 may be integrally formed within or as part of top cap 344. Moreover, top cap 344 may be a multi-piece assembly that allows for installation of various components including, for example, spring 356 and/or spring cover 357. Top cap 344 may be, for example, a clamshell assembly having two halves that thread together. A first portion 344A of the clamshell assembly of top cap 344 may comprise a washer 352-2 that is configured to provide a seat or loading surface for spring 356 and a seating surface for spring cover 357. Moreover, a second portion 344B of a clamshell assembly of top cap 344 may comprise an integrally formed fastener 354-2 and washer 352-3. In this regard, the first portion 344A and second portion 344B of the clamshell assembly of top cap 344 may be operatively coupled to one another with various fasteners, threading and/or the like.

In various embodiments, the second end 342B of tension rod 342 may comprise a threaded portion 342D that is configured to thread through and/or pass through one or more components of top cap 344, including, for example, spring 356, washers 352-2 and 352-3, spring cover 357, fastener 354-2, housing 343, and/or the like. In this regard, the second end 342B of tension rod 342 may comprise a threaded portion 342D and a guide portion 342E having a tip with a reduced diameter and/or a chamfered edge.

In various embodiments, the second end 342B of tension rod 342 may pass through top cap 344 allowing engagement with a base or superstructure of a molten metal pump.

Figures 1, 5A:
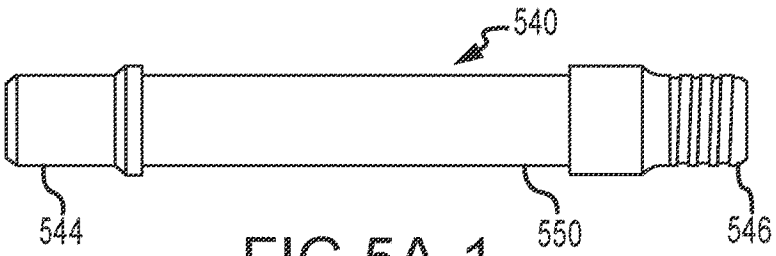
Figure 5B:
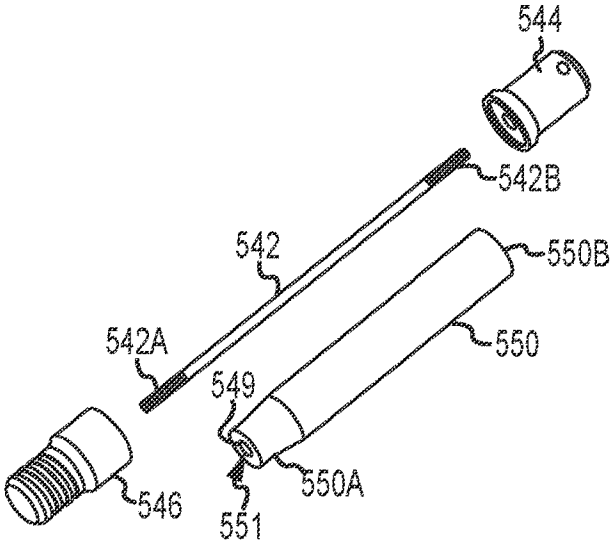
Figures 2, 5A:
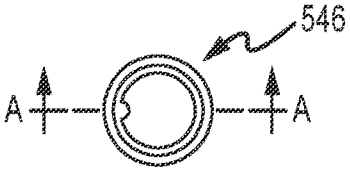
Figure 5C:
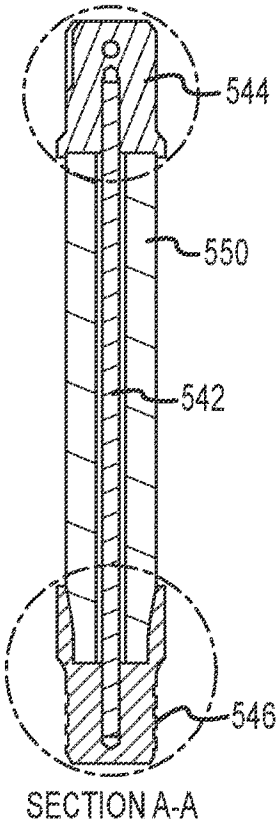
Figure 5E:
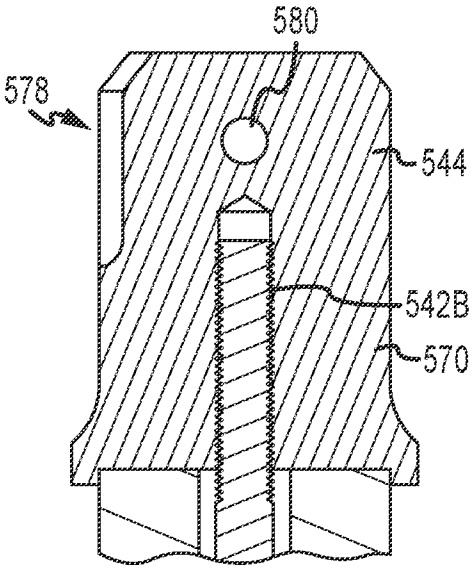
Figure 5D:
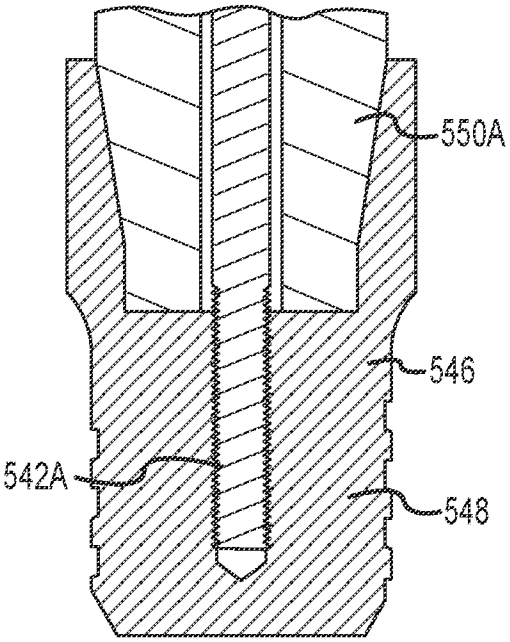

FIGS. 5A-5C illustrate a support post 540, also suitable as support post 140, in accordance with additional exemplary embodiments. Support post 540 includes a tube 550, a tension rod 542, a bottom cap 546, and a top cap 544. Tension rod 542 can be disposed within a cavity 551, which is defined by an inner wall 549 or tube 550.

Figure 5G:
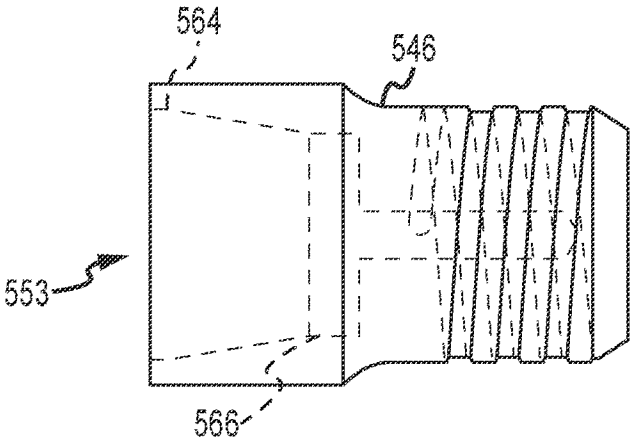
Figure 5F:
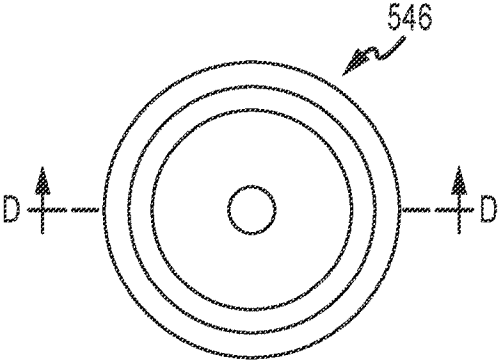
Figure 5H:
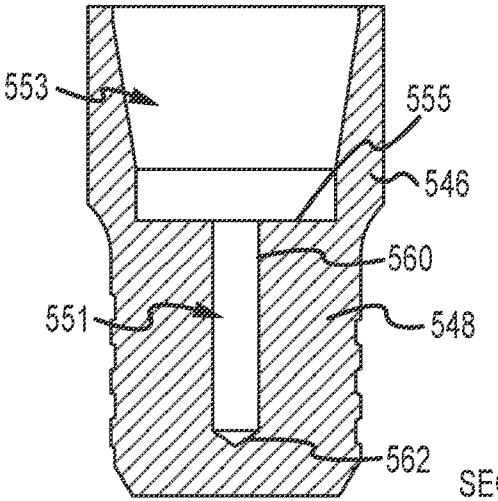

FIG. 5D and FIGS. 5F-5H illustrate bottom cap 546 in greater detail. Bottom cap 546 includes a housing 548 to receive a first end 542A of tension rod 542. In the illustrated example, housing 548 includes a recess 551 to threadedly or otherwise engage with first end 542A of tension rod 542. As illustrated in FIG. 5H, recess 551 can include a substantially cylindrical section 560 and a conical section 562 that comes to a point. Housing 548 also includes a recess 553 to receive a first end 550A of tube 550. Recesses 552 and 551 can be coaxial. As illustrated in FIG. 5G, recess 553 includes a tapered section 564 and a cylindrical section 566. Recess 553 includes a flat surface 555, having a hole therethrough to receive first end 542A of tension rod 542.

Top cap 544, illustrated in greater detail in FIGS. 5E and 5O-5R, includes a housing 570 to receive a second end 542B of tension rod 542. In the illustrated example, housing 570 includes a recess 571 to threadedly or otherwise engage with second end 542B of tension rod 542. Recess 571 can include a first substantially cylindrical section 572, a second substantially cylindrical portion 573, and a conical section 574 that comes to a point 575. Housing 570 or top cap 544 also include a recess 576 that includes a (e.g., flat) surface 577 that engages with and can contact second send 550B of tube 550. Top cap 544 can also include a notch on at least a portion of housing 570. Top cap 544 can also include a hole 580 extending partially or entirely through housing 570.

Top cap 544 and bottom cap 546 can be attached (e.g., threadedly) to second end 542B and first end 542A, respectively, of tension rod 542 to apply a compressive load to tube 550.

Figure 5J:
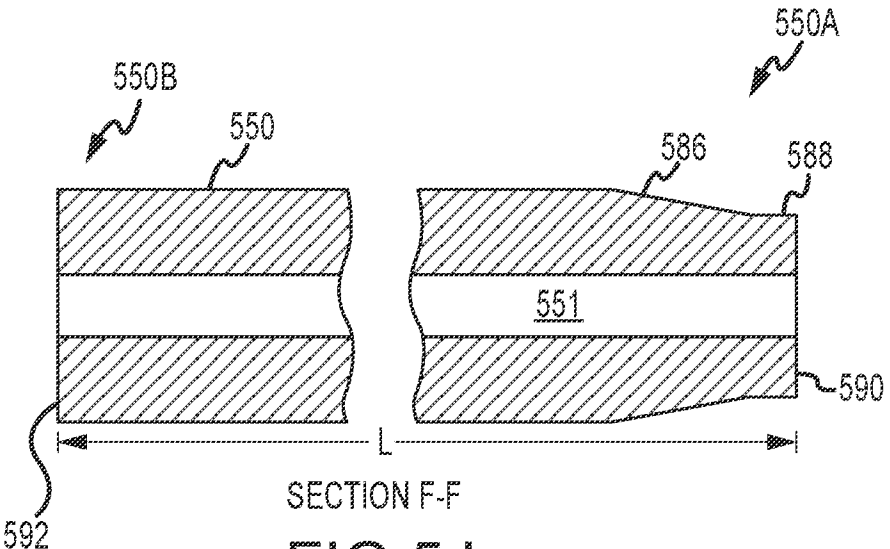
Figure 5I:
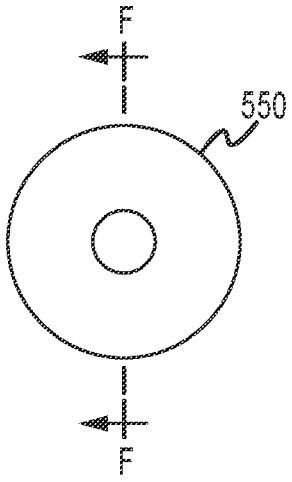
Figure 5K:
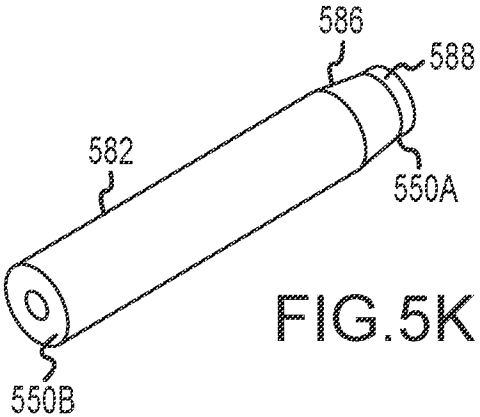

FIGS. 51-5K illustrate tube 550 in greater detail. Tube 550 includes a first cylindrical portion 582, a tapered portion 586, and optionally a second cylindrical portion 588. As illustrated in FIG. 5J, cavity 551 extends through portions 582, 586, and 588. Cavity 551 can be tapered, such that an opening at first end 550A is smaller than the opening of cavity 551 at second end 550B. For example, the opening at second end 550B can have a diameter of about 1.6 inches and the opening at first end can have a diameter of about 1.4 inches, when a length L of tube 550 ranges from about 27.9 to about 38.5 inches.

First end 550A of tube 550 includes tapered portion 586 and optional cylindrical portion 588. As illustrated in FIG. 5C, portions 586 and 588 can be received by housing 548 of bottom cap 546. First end 550A also include a face 590, which can be flat or substantially flat, so as to engage (e.g., contact) surface 555 of bottom cap 546. Similarly, second end 550B includes a face 592 that can be flat and configured to engage with and/or contact surface 577 of top cap 544. A portion of first cylindrical portion 582 can be received within recess 576, so that face 592 contacts surface 577. Recess 576 can be, for example, about ¾ inches thick with a diameter of about 5.05 inches.

Figure 5M:
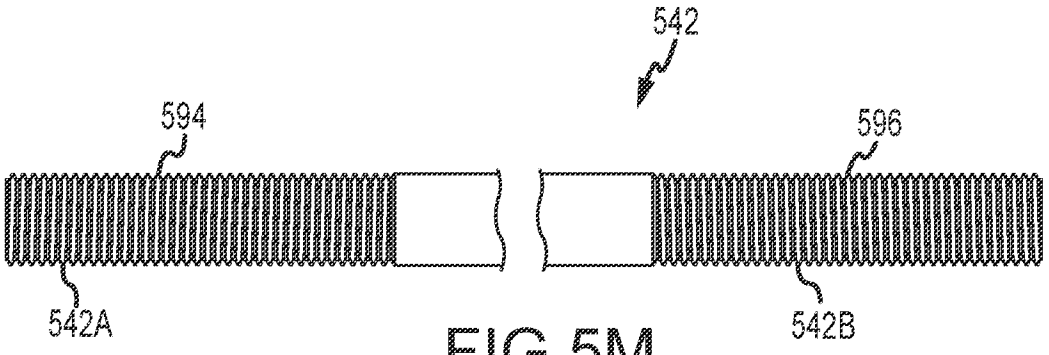
Figure 5L:
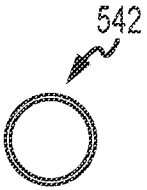
Figure 5N:
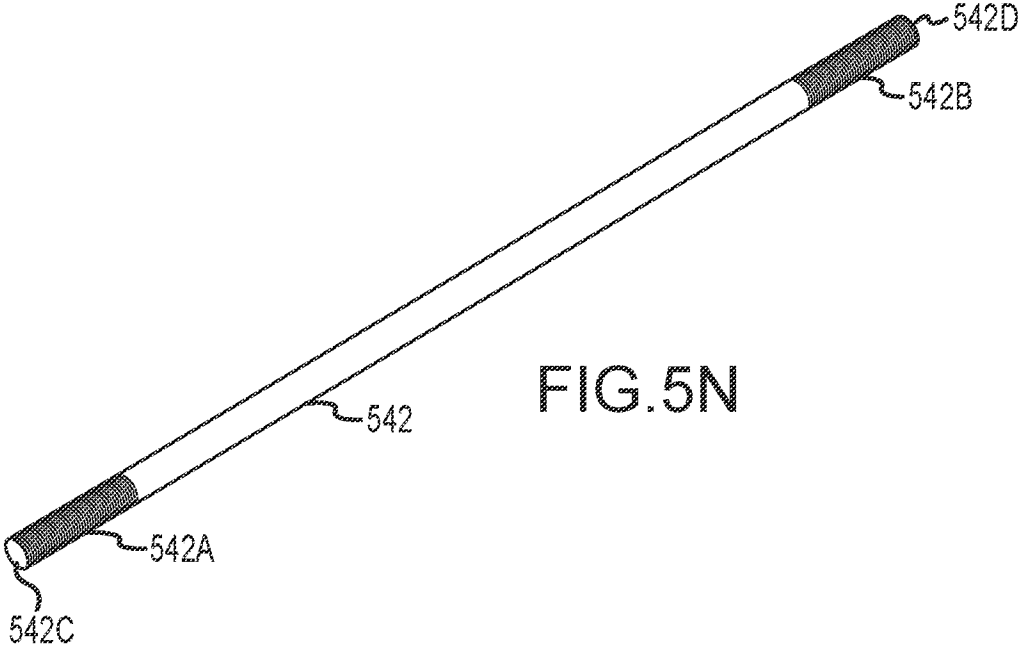
Figure 5P:
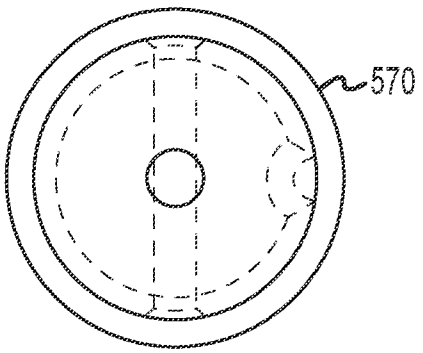
Figure 5R:
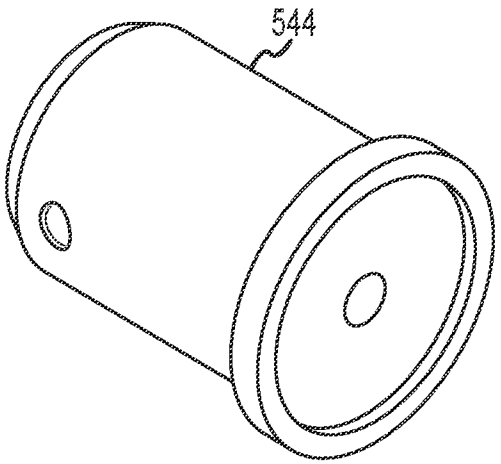
Figure 5O:
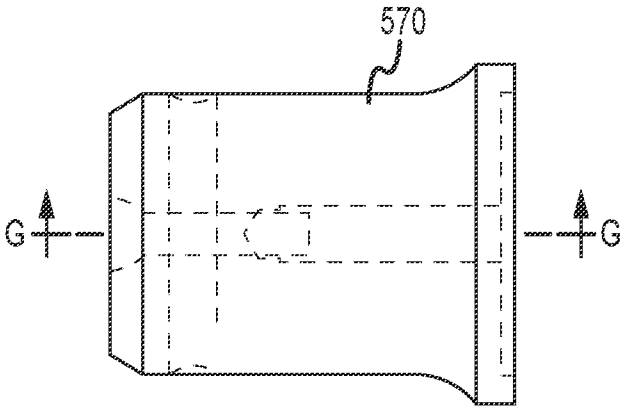
Figure 5Q:
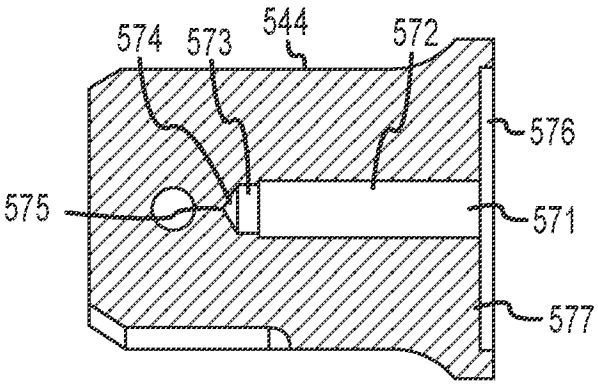

FIGS. 5L-5N illustrate tension rod 542 in greater detail. As previously noted, tension rod includes first end 542A, which includes an engagement mechanism 594, such as threads. Similarly, second end 542B includes an engagement mechanism 596, such as threads. Engagement mechanisms 594 and 596 allow top cap 544 and bottom cap 546 to attach to tension rod 542, so as to allow a compressive force to be applied to tube 550. As illustrated, ends 542C and 542D or tension rod 542 can include a flat face that is perpendicular to the axis of tension rod 542.

FIGS. 6A-6J illustrate a rotor shaft in accordance with various embodiments of the disclosure. Rotor shaft 600 includes an outer tube 602, an inner rod 604, a cap 606, and a structure 618. Rotor shaft 600 is attached to a rotor 608.

Outer tube 602 includes a first end 610, a second end 612, and an outer surface 612. Outer tube 602 includes a cavity 614 spanning therethrough to receive inner rod 604. Outer tube 602 can be formed of, for example, a ceramic, such as silicon carbide.

Inner rod 604 can include a rod (e.g., steel) that is partially threaded—e.g., including first (e.g., threaded) portion 615 and second (e.g., threaded) portion 616. Structure 618, such as a nut, can be threadedly attached to second threaded portion 616 to retain rotor 608 proximate or adjacent second end 612. First portion 615 can be used to engage with cap 606 to retain cap 606 proximate or adjacent first end 610. Rotor shaft 600 can also include a washer 620—e.g., between rotor 608 and nut 618.

Cap 606 and portions thereof are illustrated in more detail in FIGS. 6D-6J. Cap 606 includes a first section 622 having a top section 623 configured to engage with a coupling (an exemplary coupling is described in more detail below) and a bottom section 624 configured to engage with outer tube 602 and inner rod 604. Top section 622 can be of substantially tubular shape, having one or more L-shaped openings 626 formed therein to connect cap 606 to a coupling. Bottom section 624 includes a cavity 626 to receive inner rod 604, a first recess 628 to receive a bottom portion of first section 622, and a third recess 630 to receive a top surface of first end 610 of outer tube 602. Cap 606 can be formed of, for example, steel. Further, cap 606 can be configures, such that when cap 606 is connected to a coupling and the coupling drives rotor shaft 600, rotor shaft 600 moves in a direction that tightens the cap against first end 610 of outer tube 602 to apply axial pressure on outer tube 602.

Figure 4B:
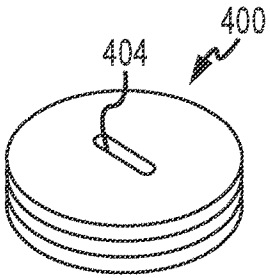
FIGS. 4A-4C illustrate a rotor plug in accordance with exemplary embodiments of the disclosure.
Figure 4A:
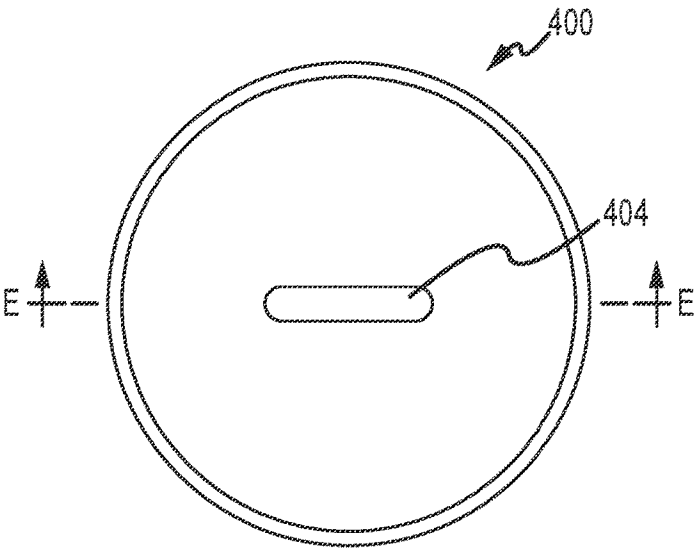
Figure 4C:
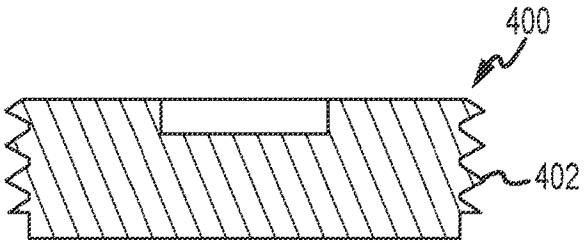
Figure 6C:
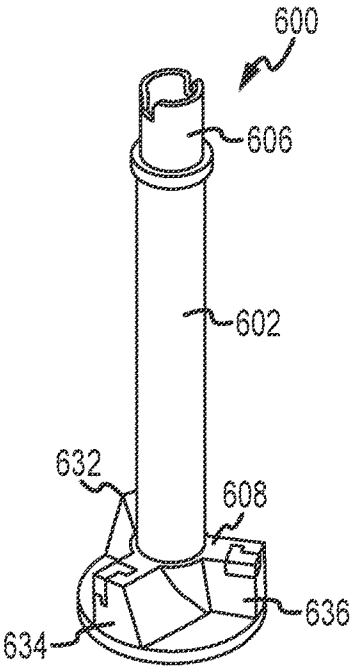
FIGS. 6A-6J illustrate a rotor shaft and various components thereof in accordance with additional exemplary embodiments of the disclosure.
Figure 6B:
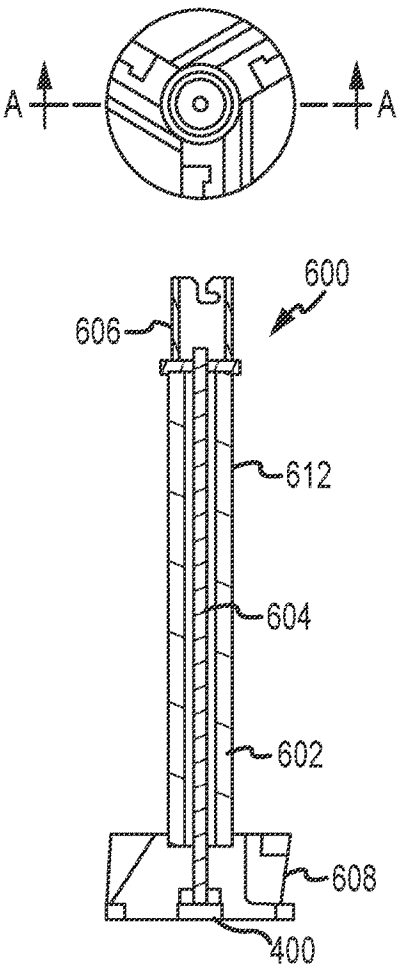
Figure 6A:
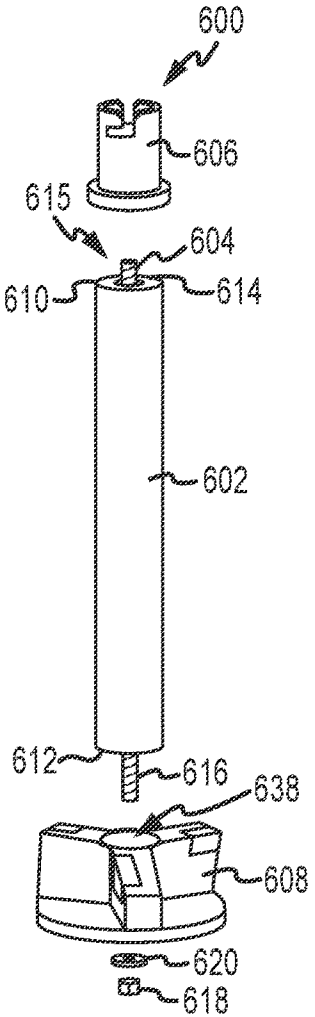
Figure 6E:
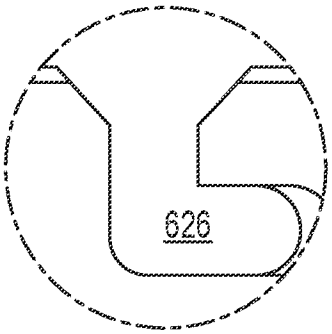
Figure 6G:
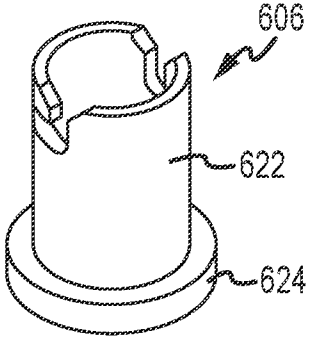
Figure 6D:
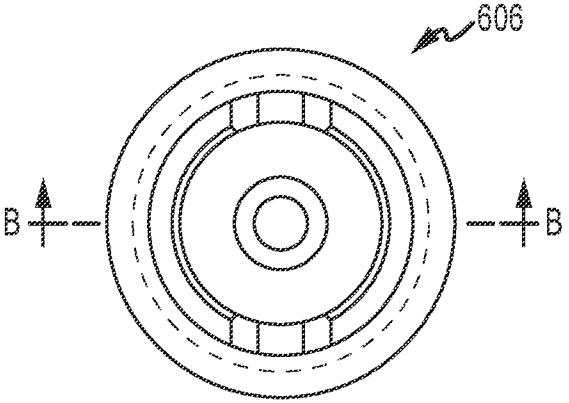
Figure 6F:
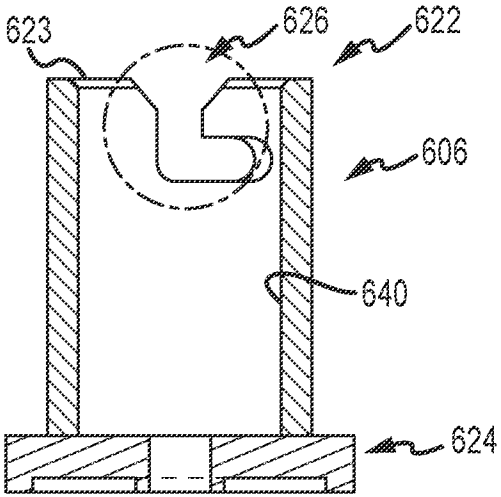
Figure 6I:
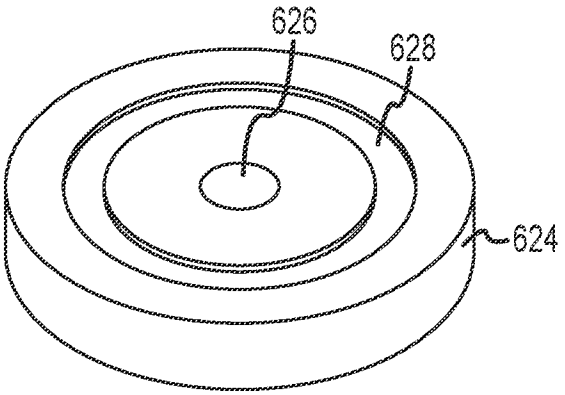
Figure 6H:
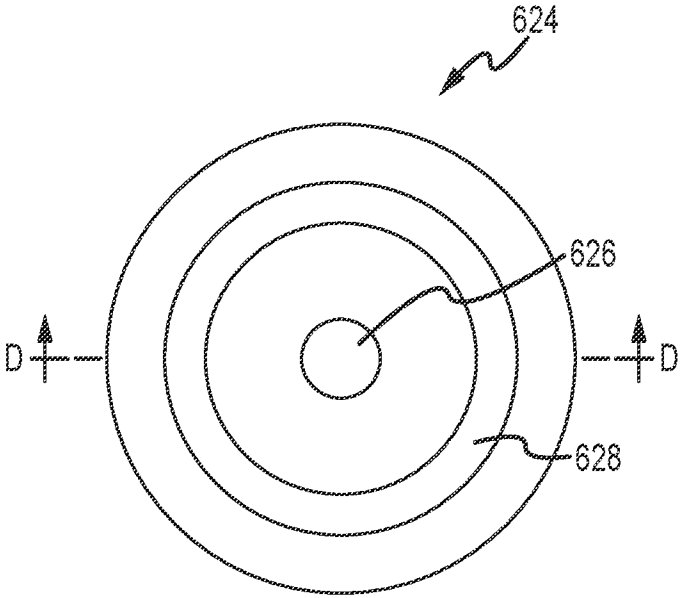
Figure 6J:
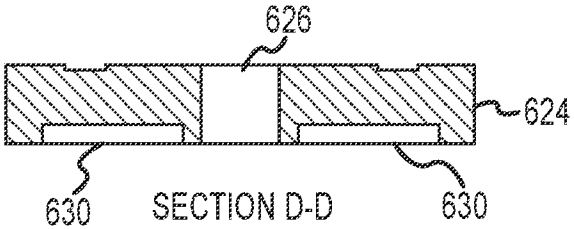

Rotor shaft 600 can also include a rotor plug 400, illustrated in FIGS. 4A-4C. Rotor plug 400 can be received by (e.g., threadedly) by rotor 608, as illustrated in FIG. 6B. Rotor plug 400 includes threads 402 to engage with rotor 608. Rotor plug 400 can also include recess 404 to facilitate threaded engagement of rotor plug with rotor 608.

Rotor 608 connects to second end 612 of rotor shaft 602. Rotor 608 includes one or more (e.g., a plurality) of spaced-apart blades 632-636, a passageway 638 for receiving second (e.g., threaded) end 616 of inner rod 604, a cavity for retaining structure 618 and for receiving rotor plug 400.

Figure 7D:
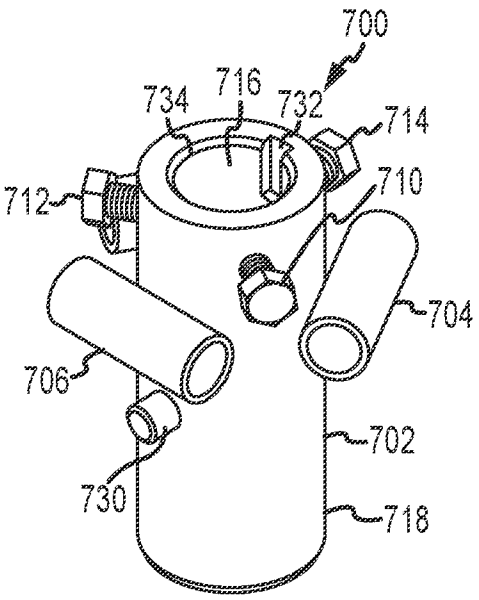
FIGS. 7A-7P illustrate a coupling and various components thereof in accordance with additional exemplary embodiments of the disclosure.
Figure 7B:
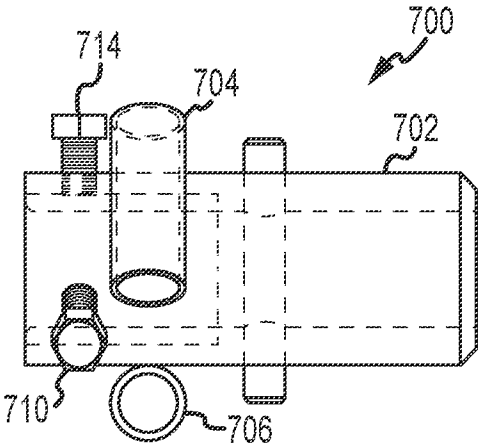
Figure 7A:
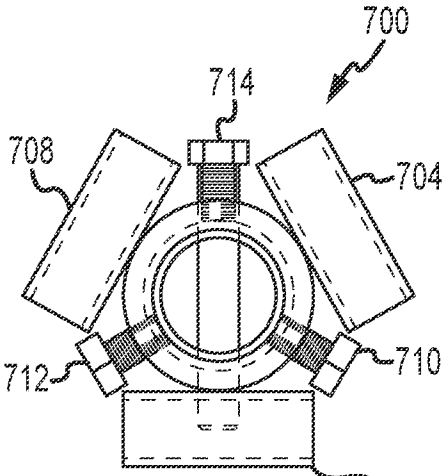
Figure 7C:
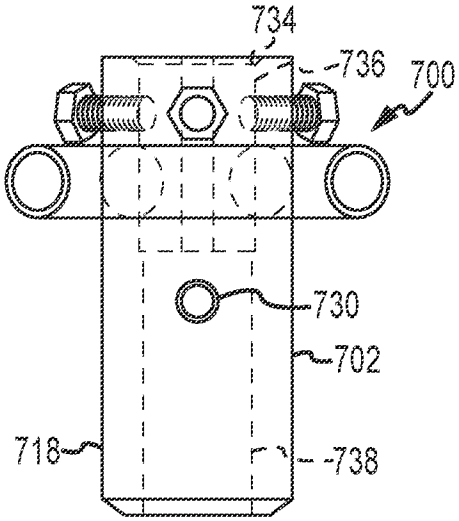
Figure 7H:
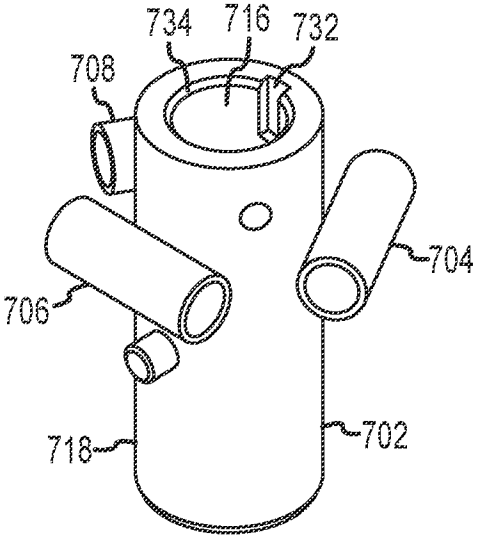
Figure 7F:
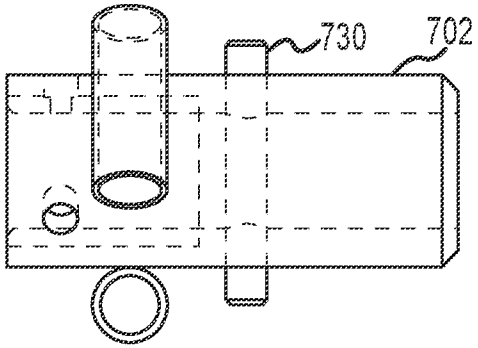
Figure 7E:
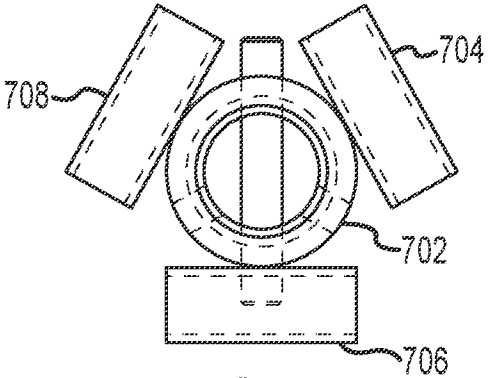
Figure 7G:
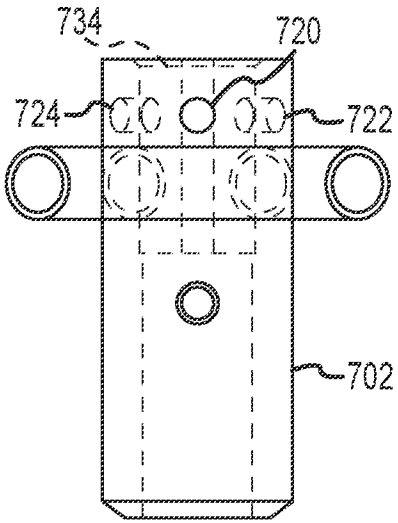
Figure 7J:
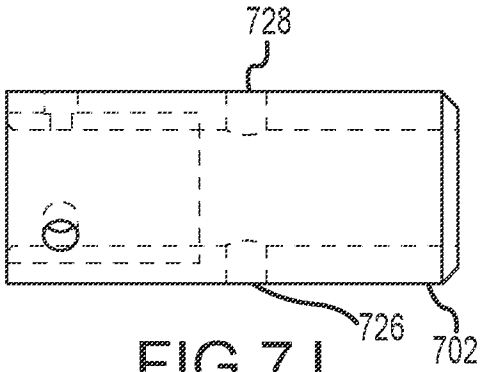
Figure 7L:
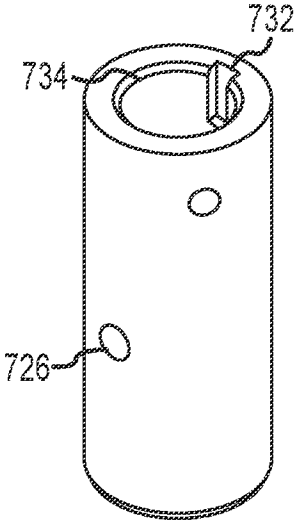
Figure 7I:
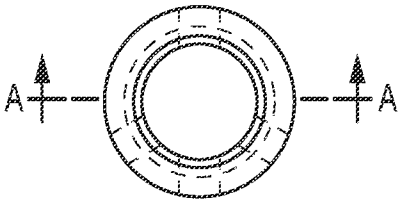
Figure 7K:
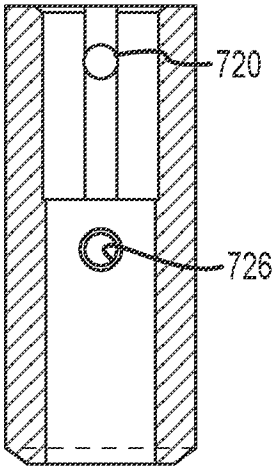
Figure 7N:
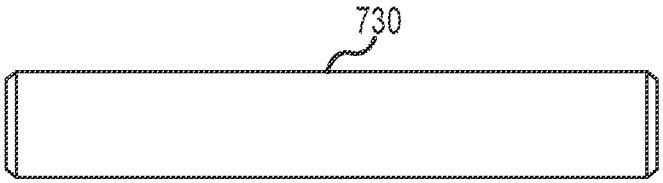
Figure 7M:
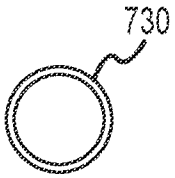
Figure 7P:
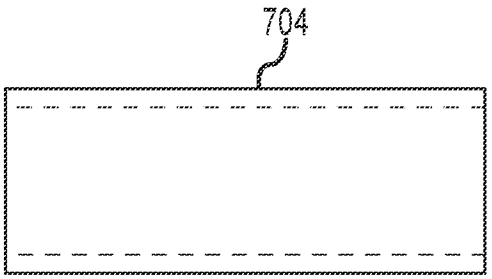
Figure 7O:
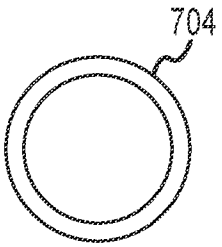

FIGS. 7A-7P illustrate a coupling 700 suitable for use with a rotor shaft for a molten metal device. Coupling 700 includes a body 702, one or more securing structures 704-708, and one or more tightening structures 710,712, and 714. Coupling 700 can be used to couple rotor shaft 602 to, for example, a motor shaft (also referred to herein as a motor post). Each of the components of coupling 700 can be formed of steel (e.g., hardened steel).

Body 702 includes an opening 716 to receive a motor shaft from a motor, described in more detail below, and an outer surface 718 to be received by an inner surface 640 of cap 606 of rotor shaft 600. Body 702 also includes openings 720, 722 and 724 to receive (e.g., threadedly) one or more (e.g., manual) tightening structures 710-714. Body 702 also includes opening 726 and 728 to receive a rod 730, which can be a hardened steel rod having, for example a diameter of about 0.75 inches and a length of about 4.75 inches. Body 702 can further include a notch 732 and/or recessed region 734. In the illustrated example, opening 716 includes recessed region 734, a first section 736, and a second section 738. A diameter of the opening of recessed region 734 is larger than the diameter of the opening of first region 736, and the diameter of the opening of first region 736 is larger than a diameter of the opening of second region 738. Each of the recessed region 734, the opening in the first region, and the opening in the second region can be cylindrical.

Securing structures 704-708 can be in the form of tubes formed of, for example, schedule 40 pipe, having a one inch diameter (e.g., about 1.049" ID and about 1.315" OD) and a length of about 3.5 inches. Securing structures 704-708 can be welded to outer surface 718—e.g., evenly spaced along the same height of outer surface 718. In the illustrated example, three securing structures 704-708 are welded to outer surface 718.

Figure 8A:
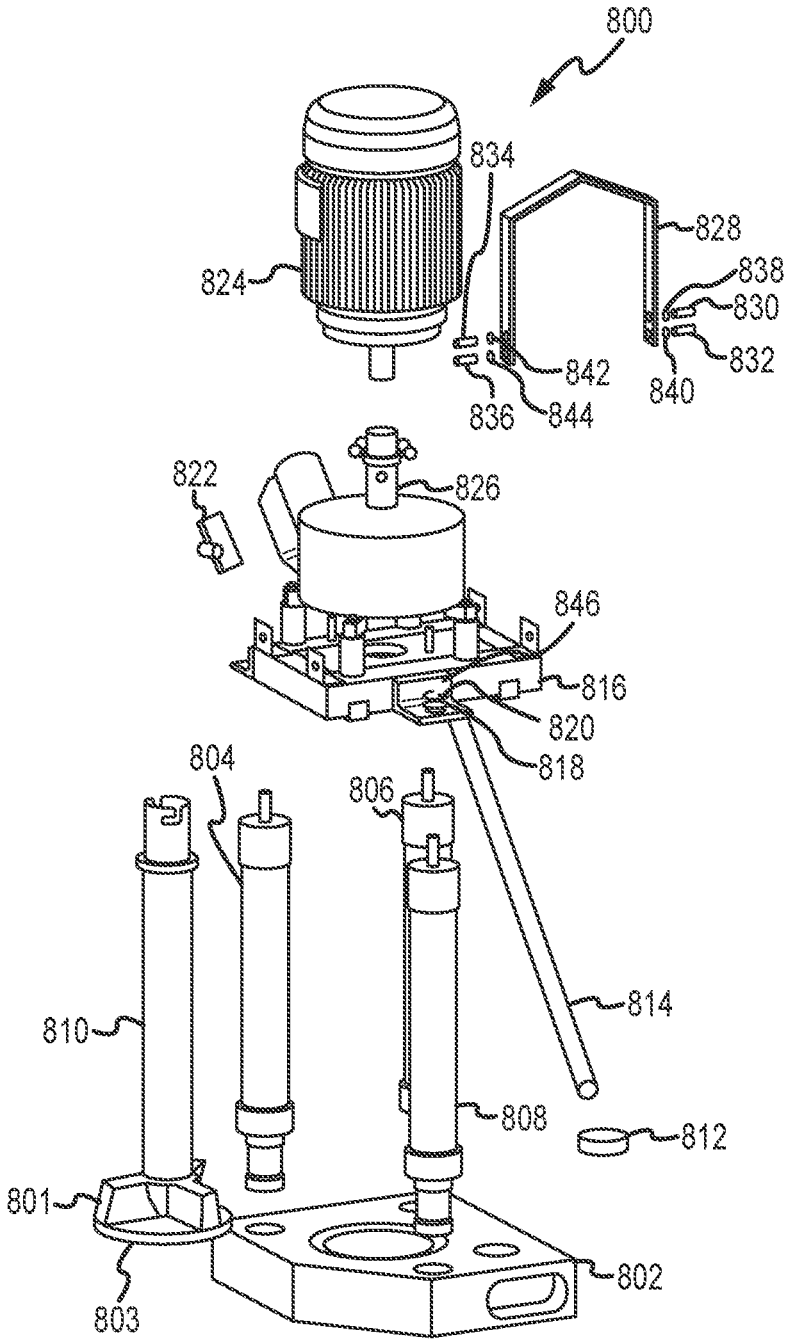
FIGS. 8A-8T illustrate a pump and various components thereof in accordance with exemplary embodiments of the disclosure.
Figure 8C:
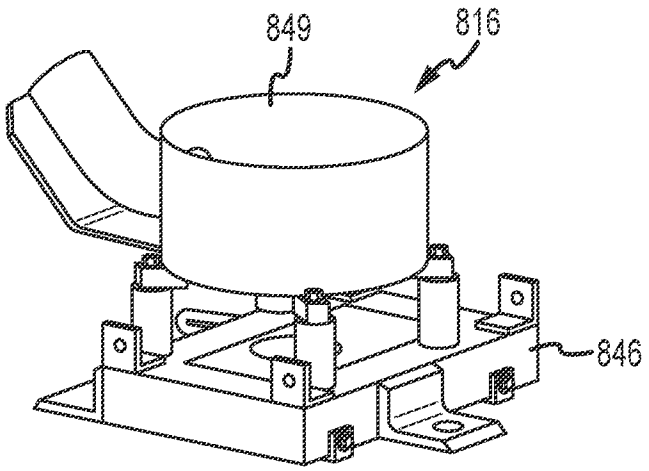
Figure 8B:
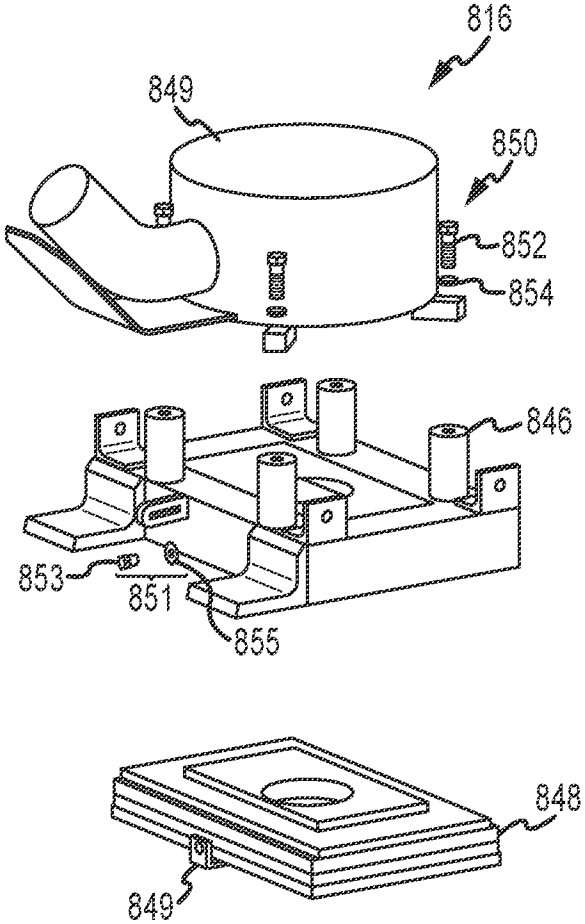
Figure 8D:
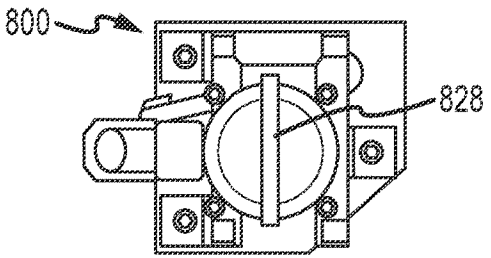
Figure 8E:
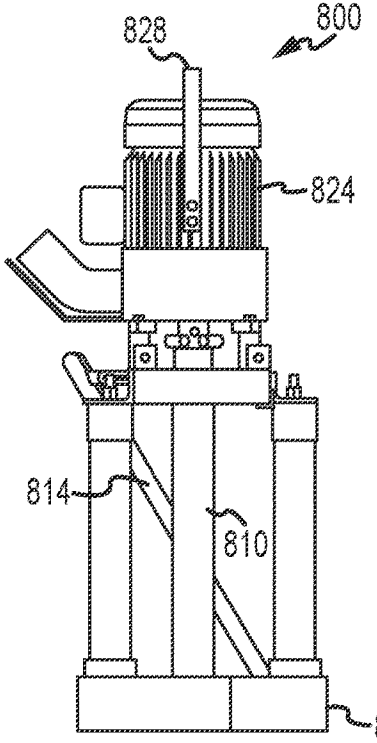
Figure 8F:
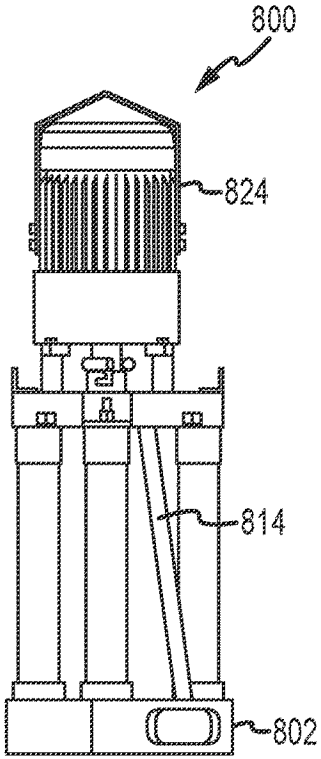
Figure 8G:
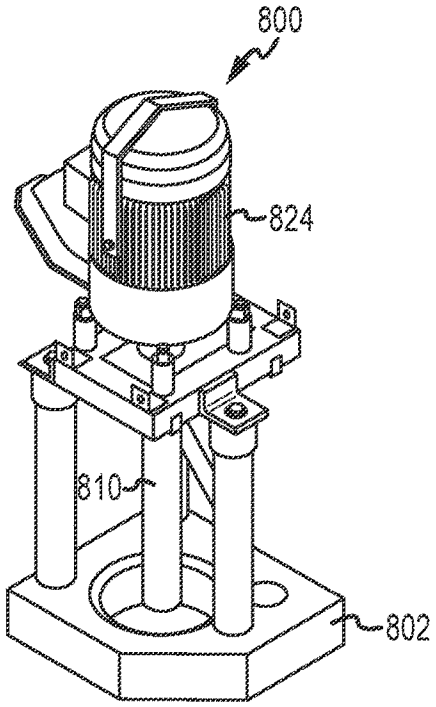
Figure 8L:
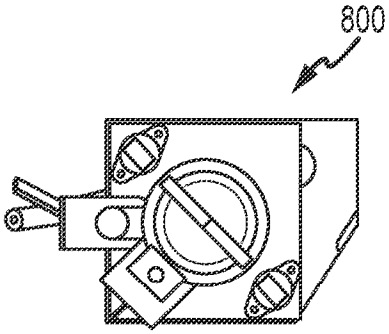
Figure 8M:
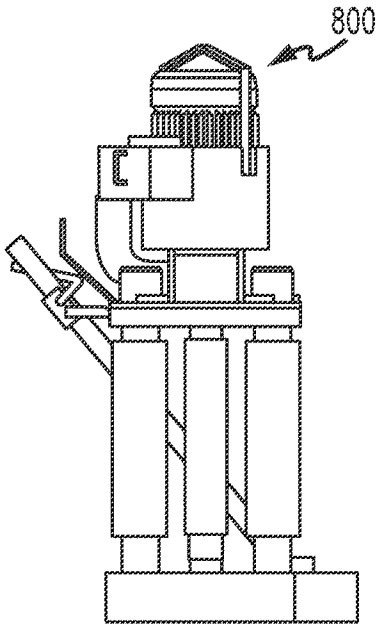
Figure 8J:
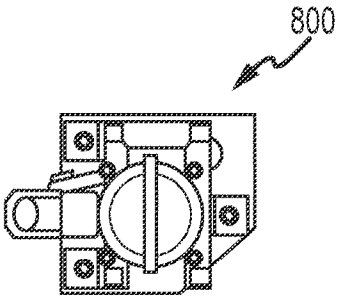
Figure 8K:
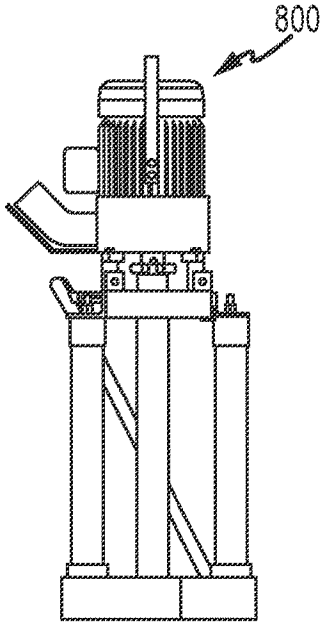
Figure 8H:
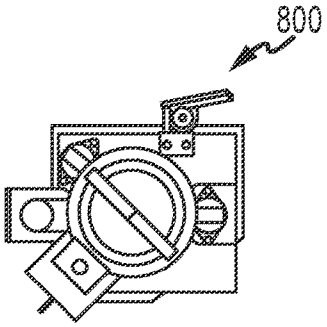
Figure 8I:
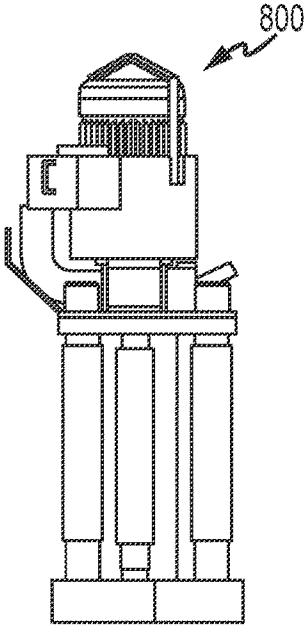
Figure 8P:
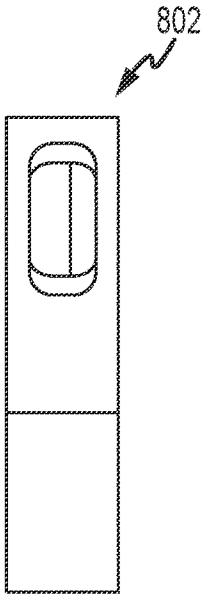
Figure 8N:
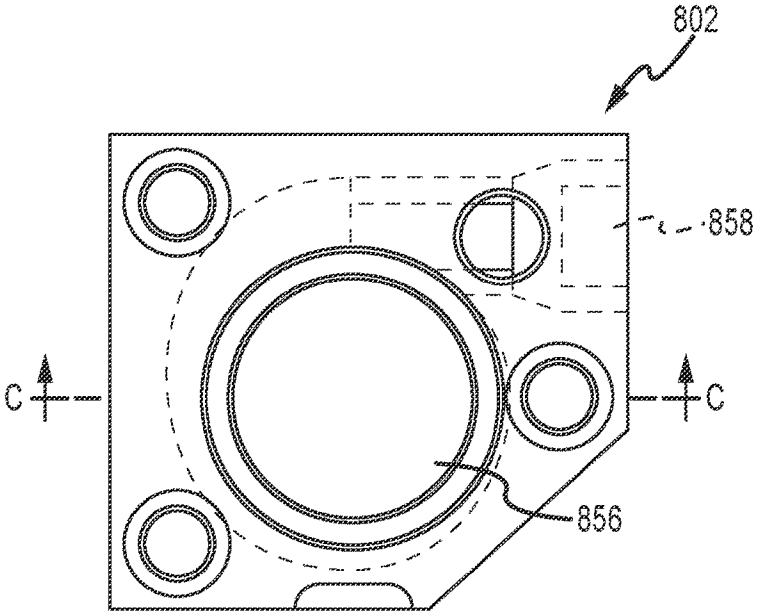
Figure 8O:
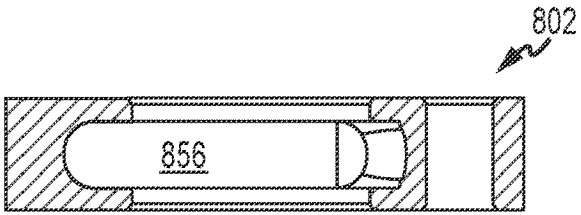
Figure 8Q:
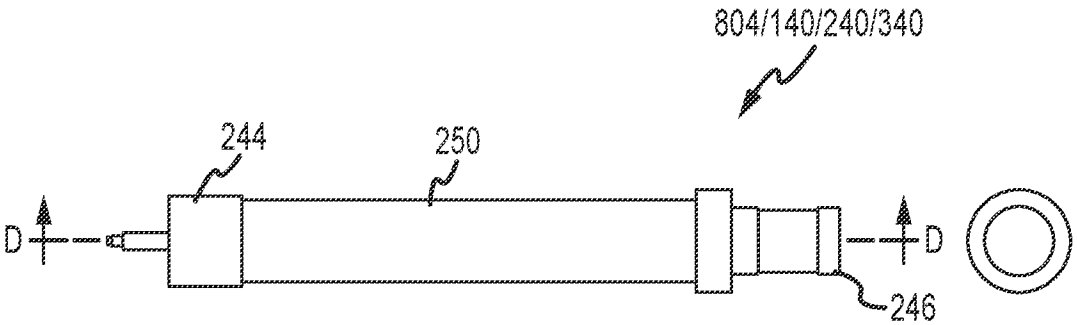
Figure 8R:
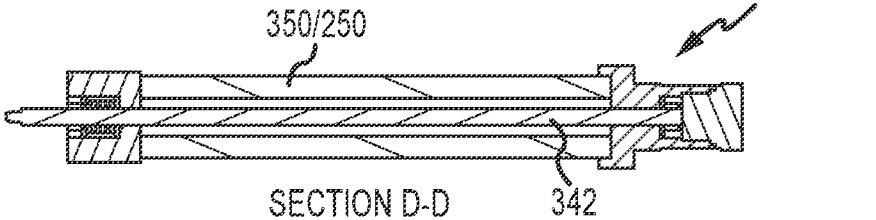
Figure 8T:
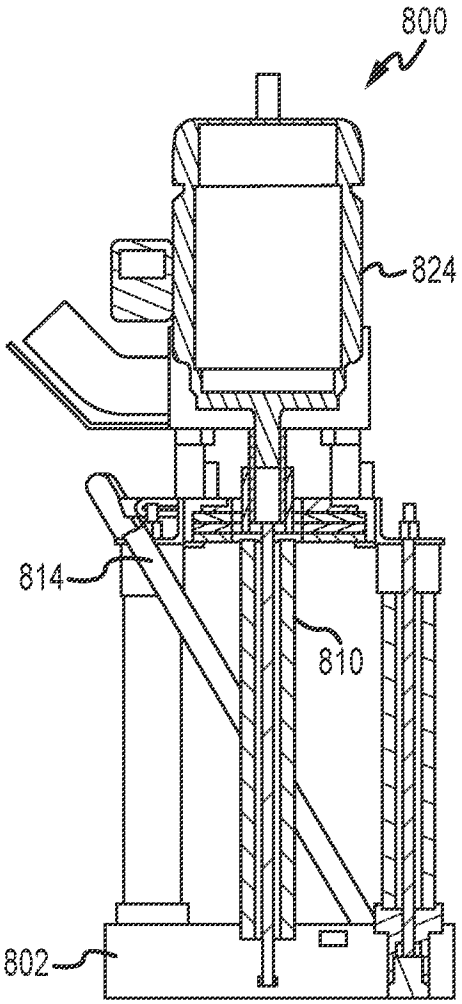
Figure 8S:
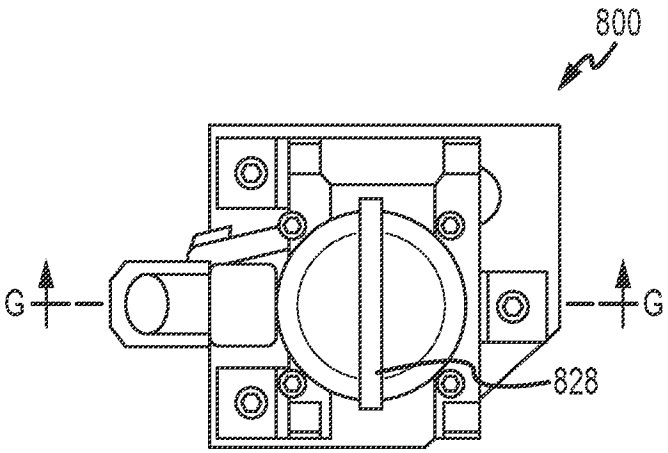

FIGS. 8A-8T illustrate a pump 800 in accordance with various embodiments of the disclosure. Pump 800 can be similar to pump 100, and similar to pump 100, pump 800 can be used for circulation or as a degasser or for demagging. Pump 800 includes a base assembly 802, one or more support posts 806-808, a rotor shaft 810, an injection button 812, an injection tube 814, a pump mount assembly or superstructure 816, a washer 818 and a lock washer 820, an injection tube clamp 822, a motor 824, a coupling 826, a motor strap 828, fasteners (e.g., bolts) 830-836 and (e.g., nuts) 838-844 and a fastener 846. Similar to pump 100, components of pump 800 that are exposed to molten metal can be formed of structural refectory materials, such as ceramic or graphite, that are resistant to degradation in the molten metal.

Pump mount assembly 816 includes a pump mount 846, pump mount insulation 848, a motor mount plate 849, one or more fasteners 850, such as bolts 852 and washers (e.g., lock washers) 854. Pump mount insulating 848 can be coupled to pump mount 846 using, for example, bracket 849 and fastener 851, which can include, for example, a bolt 853 and a washer 855. Motor mount plate 849 can be attached to pump mount 846 using fasteners 850.

Base assembly 802 includes a pump chamber 856 that can include any suitably shaped chamber, such as a generally nonvolute shape—e.g., a cylindrical pump chamber, sometimes referred to as a "cut" volute; alternatively pump chamber 856 can include a volute-shape. Pump chamber 856 can be constructed to have only one opening, either in its top or bottom, if a tangential discharge is used, since only one opening is required to introduce molten metal into pump chamber 856. Pump chamber 856 can include two coaxial openings of the same diameter, in which case usually one is blocked by a flow blocking plate 803 mounted on, or formed as part of, rotor 801. Base assembly 802 further includes a tangential discharge 858 (although another type of discharge, such as an axial discharge may be used) in fluid communication with pump chamber 856.

The one or more support posts 806-808 can be the same or similar to support posts described elsewhere herein. For example, support posts 806-810 can be support posts 140, 240, 340, or 540. Similarly, rotor shaft 810 can be the same as or similar to rotor shaft 600.

Injection button 812 can be coupled to injection tube 814. Injection tube 814 can, in turn, can be coupled to pump mount assembly 816 or another portion of pump 800 using, for example, injection tube clamp 822. Injection button 812 and injection tube 814 can be used to provide gas from a gas source to a molten metal bath, wherein injection button 812 is at least partially within the molten metal bath. The gas can be released downstream of pump chamber 856 into the pump discharge or into a stream of molten metal exiting wither the discharge or a conduit. Alternatively, gas can be released into pump chamber 856 or upstream of pump chamber 856. FIGS. 8D-8M and 8T illustrate various configurations of pump 800.

Some specific examples of embodiments of the invention follow:

1. A support post, comprising:
   a tube defining a hollow channel and having a first tube end and a second tube end;
   a tension rod having a first rod end and a second rod end disposed within the hollow channel of the tube;
   a bottom cap configured to receive the first tube end and operatively coupled to the first rod end; and
   a top cap configured to receive the second tube end and operatively couple to a portion of the tension rod, wherein the tension rod is configured to load the tube in response to be operatively coupled to the bottom cap and the top cap.
2. The support post of example 1, wherein the tube is a homogenous ceramic.
3. The support post of example 1, wherein the tube is silicon carbide.
4. The support post of example 1, wherein the tube is comprised of silicon carbide.
5. The support post of any of examples 1-4, wherein the tube comprises an interior surface, and wherein the tension rod is separated from the interior surface defining a gap between the tension rod and the interior surface.
6. The support post of any of examples 1-5, wherein the bottom cap is made of graphite.
7. The support post of any of examples 1-5, wherein the bottom cap and top cap are each comprised of one or more of graphite and silicon carbide.
8. The support post of any of examples 1-7 further comprising a fastener disposed within the bottom cap and configured to engage the tension rod to retain the tension rod within the bottom.
9. The support post of example 8, wherein a portion of the tension rod adjacent the first rod end is threaded and configured to receivably engage the fastener.
10. The support post of example 7 or 8 further comprising a washer installable over the first rod end of the tension rod and engagable by the fastener, wherein the fastener is configured to load the tension rod.
11. The support post of any of examples 1-10, wherein the bottom is a two-piece assembly that is configured to isolate the tension rod from a molten metal environment.
12. The support post of any of examples 1-11, further comprising a spring disposed within the top cap and installable over the second rod end.
13. The support post of example 12, wherein the spring is configured to load the tension rod.
14. The support post of example 12, further comprising a first washer, a second washer, and a fastener, wherein the spring is disposed between the first washer and the second washer and retained by the fastener within the top cap.
15. The support post of example 14, a portion of the tension rod adjacent the second rod end is threaded and is configured to receive the fastener.
16. The support post of any of examples 1-15, wherein the second rod end is configured to protrude through the top cap.
17. A molten metal pump comprising:
   a superstructure;
   a motor having a motor post with a first post end connected to the motor and a second post end;
   a rotor shaft operatively coupled to the second post end;
   a support post comprising,
   a tube defining a hollow channel;
   a tension rod having a first rod end and a second rod end disposed within the hollow channel of the tube;
   a bottom cap operatively coupled to the first rod end; and
   a top cap operatively coupled to a portion of the tension rod, wherein the tension rod is configured to load the tube in response to be operatively coupled to the bottom cap and the top cap; and
   a base coupled to the superstructure by the support post.
18. A molten metal pump comprising:
   a superstructure;
   a motor having a motor post with a first post end connected to the motor and a second post end;
   a rotor shaft operatively coupled to the second post end;
   a plurality of support posts, each of the plurality of support posts comprising,
   a tube defining a hollow channel;
   a tension rod disposed within the hollow channel of the tube;
   a bottom cap operatively coupled to the tension rod; and
   a top cap operatively coupled to the tension rod, wherein the tension rod is configured to load the tube in response to be operatively coupled to the bottom cap and the top cap; and
   a base coupled to the superstructure by the plurality of support posts.
19. A molten metal pump containing one of the support posts of examples 1-17.
20. A rotor shaft for use in a molten metal device, the rotor shaft comprising:
   an outer tube having a first end, a second end, and an outer surface;
   an inner rod having a first end and a second end;
   a cap that threads onto the first end of the inner rod, and that has an upper portion configured to be connected to a coupling that drives the rotor shaft; and
   a structure that retains the second end of the outer tube;
   wherein when the cap is connected to the coupling and the coupling drives the rotor shaft, the rotor shaft moves in a direction that tightens the cap against the first end of the outer tube to apply axial pressure on the outer tube.
21. The rotor shaft of example 20 wherein the outer tube is comprised of ceramic.
22. The rotor shaft of example 21 wherein the ceramic is silicon carbide.
23. The rotor shaft of any of examples 20-22 wherein the structure that retains the second end of the outer tube is a nut threaded onto the second end.
24. The rotor shaft of example 23 that further includes a washer on the second end.
25. The rotor shaft of any of examples 20-23 that further includes a rotor and a rotor plug received in the bottom of the rotor.

26. The rotor shaft of any of examples 20-25 wherein the upper portion of the cap includes one or more L-shaped openings to connect to the coupling.

27. A rotor for being connected to a rotor shaft used in a molten metal device, the rotor comprising a plurality of spaced-apart blades, a passageway for receiving the second end of a rotor shaft according to any of examples 20-24 or 26, and a cavity for retaining a structure that retains the second end of the rotor shaft.

28. The rotor shaft of example 27 wherein the structure is a nut threadingly received on the second end.

29. The rotor shaft of either of examples 27-28 that further includes a rotor cap on a bottom of the rotor, the cap for covering the cavity.

30. A coupling for use with a rotor shaft for a molten metal device, the coupling comprising:

a body including an opening for receiving a rotor shaft, and one or more securing structures to retain the rotor shaft in the opening;

one or more manual tightening structures on the outer surface.

31. The coupling of example 30 that has two tightening structures.

32. The coupling of any of examples 30-31 wherein the tightening structures are bolts threaded through the body of the coupling.

33. The coupling of any of examples 30-32 wherein the manual tightening structures are tubes welded to the outer surface.

34. The coupling of any of examples 30-33 that is comprised of steel.

35. The coupling of any of examples 30-34 wherein the opening is cylindrical.

36. The coupling of any of examples 30-35 that further includes two openings for receiving a through bolt.

37. The coupling of example 36 that further includes a through bolt.

38. A molten metal pump comprising the coupling of any of examples 30-37.

39. A rotary degasser comprising the coupling of any of examples 1-37.

40. The rotor shaft of example 23 wherein the nut is retained inside of a rotor.

41. The rotor shaft of example 24 wherein the nut and washer are retained inside of a rotor.

Having thus described different embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result. Further, any dimensions provided herein are provided for reference only. Unless otherwise stated, the invention is not limited to components having such dimensions.

What is claimed is:

1. A rotor shaft for use in a molten metal device, the rotor shaft comprising a first end, a second end, and further comprising:

(a) a hollow outer tube having a first end at the first end of the rotor shaft, a second end at the second end of the rotor shaft, a tube body, and an outer surface;

(b) a tension rod having a first end at the first end of the rotor shaft and a second end at the second end of the rotor shaft;

(c) a cap threaded onto the first end of the tension rod, wherein the cap has an upper portion configured to be connected to a coupling that drives the rotor shaft; and (d) a structure that retains the second end of the tension rod and the second end of the outer tube;

wherein when the cap is connected to the coupling and the coupling drives the rotor shaft, the rotor shaft moves in a direction that tightens the cap onto the first end of the tension rod to apply axial pressure to the first end of the outer tube.

2. The rotor shaft of claim 1, wherein a fastener is threaded onto the second end of the tension rod.

3. The rotor shaft of claim 2 that further comprises a washer on the second end of the tension rod.

4. The rotor shaft of claim 1, wherein the tension rod is formed of steel.

5. The rotor shaft of claim 1, wherein the upper portion of the cap comprises one or more L-shaped openings configured to connect to the coupling.

6. The rotor shaft of claim 1, wherein the cap is comprised of steel.

7. The rotor shaft of claim 1, wherein the cap is comprised of one or more of graphite and silicon carbide.

8. The rotor shaft of claim 1, wherein the second end of the rotor shaft is configured to be attached to a rotor.

9. The rotor shaft of claim 8, wherein the second end of the rotor shaft is connected attached to the rotor.

10. The rotor shaft of claim 8, wherein the second end of the rotor shaft is threaded.

11. The rotor shaft of claim 1, wherein the outer tube comprises one or both of ceramic and graphite.

12. The rotor shaft of claim 1, wherein the outer tube comprises silicon carbide.

13. The rotor shaft of claim 1, wherein the outer tube further comprises an interior surface, the tension rod is separated from the interior surface and there is a space between the tension rod and the interior surface.

14. The rotor shaft of claim 9, wherein the rotor is comprised of graphite.

15. The rotor shaft of claim 9, wherein the second end of the rotor shaft is connected to the rotor by a threaded connection.

16. The rotor shaft of claim 9, wherein the rotor is configured to isolate the second end of tension rod from a molten metal environment.

17. The rotor shaft of claim 16, wherein the rotor further comprises a cavity in which the second end of the tension rod is positioned.

18. The rotor shaft of claim 16, wherein the second end of the tension rod is connected to the rotor by a threaded connection.

19. The rotor shaft of claim 16 that further comprises a rotor plug received in the bottom of the rotor, wherein the rotor plug is configured to keep molten metal out of a cavity of the rotor.

20. The rotor shaft of claim 9, wherein the rotor comprises a passageway for receiving the second end of the rotor shaft, and a cavity for retaining a structure that retains the second end of the tension rod in the cavity.

21. The rotor shaft of claim 20, wherein the structure is a nut threadingly received on the second end of the tension rod.

22. A molten metal pump comprising the rotor shaft of claim 1.

23. The molten metal pump of claim 22 that further comprises:

(a) a superstructure;

(b) a motor having a motor shaft with a first end connected to the motor and a second end connected to a coupling;

(c) the coupling having a second end that is connected to the rotor shaft;

(d) one or more support posts having a first end connected to the superstructure, and;

(e) a base connected to a second end of each of the one or more support posts.

* * * * *